US007431438B2

(12) United States Patent
Tsujimoto et al.

(10) Patent No.: US 7,431,438 B2
(45) Date of Patent: Oct. 7, 2008

(54) INK CARTRIDGE, RECORDING APPARATUS EMPLOYING INK CARTRIDGE, AND MANUFACTURING METHOD FOR INK CARTRIDGE

(75) Inventors: Akira Tsujimoto, Yokohama (JP); Junji Shimoda, Chigasaki (JP); Kiyomitsu Kudo, Machida (JP); Satoshi Kudo, Yokohama (JP); Toru Suzuki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 154 days.

(21) Appl. No.: 10/513,669

(22) PCT Filed: Apr. 23, 2004

(86) PCT No.: PCT/JP2004/005892

§ 371 (c)(1),
(2), (4) Date: Jul. 21, 2005

(87) PCT Pub. No.: WO2004/096558

PCT Pub. Date: Nov. 11, 2004

(65) Prior Publication Data

US 2005/0270344 A1 Dec. 8, 2005

(30) Foreign Application Priority Data

Apr. 25, 2003 (JP) ..... 2003-122004
Apr. 25, 2003 (JP) ..... 2003-122007
Mar. 29, 2004 (JP) ..... 2004-095261

(51) Int. Cl.
*B41J 2/175* (2006.01)

(52) U.S. Cl. ..... 347/86; 347/31; 347/35; 347/36; 347/85; 347/87; 401/99; 401/117

(58) Field of Classification Search ..... None
See application file for complete search history.

(56) References Cited

U.S. PATENT DOCUMENTS 4,551,735 A 11/1985 Suzuki et al. ..... 346/140 R
4,734,719 A 3/1988 Suzuki ..... 346/140 R (Continued)

FOREIGN PATENT DOCUMENTS

| | | | |
|---|---|---|---|
| EP | 364284 | A2 * | 4/1990 |
| EP | 769380 | A2 * | 4/1997 |
| EP | 928694 | A1 * | 7/1999 |
| JP | 5-4349 | | 1/1993 |
| JP | 6-340092 | | 12/1994 |

OTHER PUBLICATIONS

American Psychological Association (APA): region. (n.d.). Dictionary.com Unabridged (v 1.1). Retrieved Nov. 14, 2007, from Dictionary.com website: http://dictionary.reference.com/browse/region Chicago Manual Style (CMS):region. Dictionary.com. Dictionary.com Unabridged (v 1.1). Random House, Inc. Modern Language Association (MLA): "region".*

*Primary Examiner*—Matthew Luu
*Assistant Examiner*—John P Zimmermann
(74) *Attorney, Agent, or Firm*—Fitzpatrick, Cella, Harper, Scinto

(57) ABSTRACT

An ink cartridge which is detachably mountable to a liquid ejection type recording device including a liquid ejecting head for ejecting liquid onto a recording material while scanning the recording material in a direction crossing with a feeding direction of the recording material, and a recovery unit for sucking the liquid through a nozzle of the liquid ejecting head. The ink cartridge includes a receiving portion for receiving the liquid discharged from the liquid ejecting head by the recovery unit; a liquid containing portion for accommodating the liquid to be supplied to the liquid ejecting head; and a connecting portion for connecting the receiving portion and the suction recovery unit, wherein the connecting portion is disposed at a position upstream of a front end surface portion of the ink cartridge with respect to an inserting direction in which the ink cartridge is inserted into the liquid ejection type recording device.

8 Claims, 14 Drawing Sheets

U.S. PATENT DOCUMENTS

| | | | | |
|---|---|---|---|---|
| 4,847,637 | A | 7/1989 | Watanabe et al. | 346/140 R |
| 5,138,344 | A * | 8/1992 | Ujita | 347/86 |
| 5,221,935 | A | 6/1993 | Uzita | 346/140 R |
| RE36,279 | E * | 8/1999 | Ujita | 347/86 |
| 5,997,129 | A * | 12/1999 | Matsuhashi | 347/35 |
| 6,123,409 | A * | 9/2000 | Wolf | 347/33 |
| 6,786,584 | B2 * | 9/2004 | Kaga et al. | 347/86 |
| 6,796,642 | B2 * | 9/2004 | Toba et al. | 347/85 |
| 6,832,830 | B2 * | 12/2004 | Seino et al. | 347/86 |
| 6,840,611 | B2 * | 1/2005 | Kudo et al. | 347/86 |
| 6,854,834 | B2 * | 2/2005 | Hara et al. | 347/85 |
| 6,874,876 | B2 * | 4/2005 | Ishizawa et al. | 347/86 |
| 6,908,184 | B2 * | 6/2005 | Shinada et al. | 347/86 |
| 7,018,029 | B2 * | 3/2006 | Ishizawa et al. | 347/86 |
| 7,114,800 | B2 * | 10/2006 | Tsujimoto | 347/86 |
| 7,152,949 | B2 * | 12/2006 | Silverbrook et al. | 347/42 |
| 7,188,936 | B2 * | 3/2007 | Usui et al. | 347/85 |
| 7,192,127 | B2 * | 3/2007 | Kudo et al. | 347/86 |
| 2003/0160848 | A1 | 8/2003 | Taniguchi et al. | 347/86 |
| 2004/0263590 | A1 * | 12/2004 | Kudo et al. | 347/86 |
| 2005/0231572 | A1 * | 10/2005 | Suzuki et al. | 347/87 |
| 2006/0232647 | A1 * | 10/2006 | Suzuki et al. | 347/86 |
| 2006/0284944 | A1 * | 12/2006 | Kudo et al. | 347/85 |

* cited by examiner (a)

(b)

(a)

(b)

(a)

(b)

INK CARTRIDGE, RECORDING APPARATUS EMPLOYING INK CARTRIDGE, AND MANUFACTURING METHOD FOR INK CARTRIDGE

TECHNICAL FIELD

The present invention relates to an ink cartridge, as a replaceable liquid container for storing ink or the like liquid, employed in an ink jet recording system. It also relates to a recording apparatus which employs said cartridge, and a manufacturing method for said cartridge. In particular, it relates to an ink cartridge tailor-made for a portable printer which is small and easy to carry, a recording apparatus which employs said cartridge, and a manufacturing method therefor.

BACKGROUND ART

It has been known that in order to prevent the recording head of an ink jet recording apparatus from becoming plugged, or to prevent the similar problems, an ink jet recording apparatus is equipped with a unit for suctioning ink from the recording head to restore the recording head in performance. As an ink cartridge which comprises a waste ink containing portion for storing the waste ink, that is, the ink suctioned away from the suction type performance recovery unit, and is replaceably mountable in an ink jet recording apparatus, there have been known a few ink cartridges structured like the one disclosed in Japanese Laid-open Patent Applications 6-340092 and 5-4349. In the case of these ink cartridges, the waste ink inlet of the waste ink containing portion is generally provided as a part of the front wall of the waste ink containing portion, in terms of the direction in which an ink cartridge is inserted into a recording apparatus. Thus, an ink jet recording apparatus which employs such an ink cartridge needs to be provided with an ink discharge tube through which waste ink can be drawn out of the main assembly of the recording apparatus, and the waste ink discharge tube needs to be located in the front portion of the recording apparatus, in terms of the ink cartridge insertion direction.

However, the above described structural arrangement is problematic for the following reason. That is, in order to make a portable printer thinner, an ink container therefor must also be made to be thinner. Thus, if the waste ink container of an ink container is structured as described above, the objective of increasing an ink container in capacity to reduce it in replacement frequency contradicts the objective of reducing a portable printer in size and thickness; in other words, it is very difficult to accomplish both objectives (first technical problem).

Further, if the waste ink holding portion itself is made as small as possible in size, it becomes difficult for the waste ink to disperse satisfactorily and quickly in the waste ink holding portion after being absorbed into the waste ink holding portion. This creates the condition that the waste ink is nonuniformly distributed in the waste ink holding portion, that is, certain areas of the waste ink holding portion become excessively saturated with the waste ink. When the waste ink holding portion is in this condition, it is possible for the waste ink therein to leak into, and/or out of, the apparatus, due to the vibrations to which the apparatus is subjected while the apparatus is carried, impacts to which the apparatus is subjected as the apparatus is dropped, and/or changes in temperature (second technical problem).

There is another problem. That is, as ink jet recording has come close in quality to silver-salt photography, ink jet recording apparatuses enabled by software technologies to record an image in a manner of covering the entire surface of a recording medium, that is, ink jet recording apparatuses capable of producing prints with no border, or margin (which hereinafter may be referred to as borderless prints), have come to be marketed. In these ink jet recording apparatuses, a single or plurality of ink absorbing members for absorbing ink are placed on a platen, across the areas where the ink droplets ejected toward slightly outside the edges of the printing paper land when the ink jet recording apparatus is in the borderless mode, so that the ink droplets ejected toward slightly outside the recording paper range are caught, absorbed, and retained by the ink absorbing members to make it possible for an image to be formed on the following recording paper without soiling the recording paper.

In the case of the above arrangement, however, the ink absorbing members are held by the platen. Therefore, in order to increase the ink absorbing members in capacity, the printer itself has to be increased in size, which is a problem. This problem is more serious in the case of a portable printer, for the following reason. That is, since a portable printer is frequently carried, it must be greater than a stationary printer, in the margin of reliability in terms of leakage. Further, the capacity of the waste ink absorbing members must be set according to not only the entire amount of ink which will be used during the duration of the service life of the main assembly of an ink jet printer, but also, the frequency of usage by a heavy user. Thus, unless an innovative approach is made, it is difficult to substantially reduce the size of an ink jet printer (third technical problem).

DISCLOSURE OF THE INVENTION

The primary object of the present invention is to solve one or more of the above described first, second, and third technical problems to provide an ink cartridge capable of contributing to the size reduction of an ink jet recording apparatus capable of borderless printing.

Another object of the present invention is to provide an ink jet recording apparatus using such an ink cartridge, and a manufacturing method for such an ink cartridge, and others relating thereto.

According to an aspect of the present invention, there is provided an ink cartridge which is detachably mountable to a liquid ejection type recording device including a liquid ejecting head for ejecting liquid onto a recording material while scanning the recording material in a direction crossing with a feeding direction of the recording material, and a recovery unit for sucking the liquid through a nozzle of the liquid ejecting head, said ink cartridge comprising a receiving portion for receiving the liquid discharged from the liquid ejecting head by the recovery unit; a liquid containing portion for accommodating the liquid to be supplied to the liquid ejecting head; and a connecting portion for connecting said receiving portion and said suction recovery unit, wherein the connecting portion is disposed at a position upstream of a front end surface portion of said ink cartridge with respect to an inserting direction in which said ink cartridge is inserted into the liquid ejection type recording device.

With the employment of the above described structural arrangement for an ink cartridge, the joint between the performance recovery unit and ink cartridge falls within the scanning range of the recording head, making it possible to place the main section (connective portion by which unit is connected to pump and cartridge) of the performance recovery unit within the range across which the recording head is moved in the scanning manner, and which is relatively spacious. Therefore, the above described first problem can be solved.

According to another aspect of the present invention, there is provided an ink cartridge which is detachably mountable to a liquid ejection type recording device including a liquid ejecting head for ejecting liquid onto a recording material while scanning the recording material in a direction crossing with a feeding direction of the recording material, a recovery unit for sucking the liquid through a nozzle of the liquid ejecting head, said ink cartridge further comprising a liquid containing portion for accommodating the liquid to be supplied to the liquid ejecting head; a first receiving portion for receiving the liquid discharged out of the liquid ejecting head by the recovery unit; and a second receiving portion for receiving the liquid ejected from the liquid ejecting head to an outside of the recording material; and a connecting portion for connecting said first receiving portion and the recovery unit with each other, wherein said engaging portion is disposed at a position downstream of said connecting portion with respect to an inserting direction in which said ink cartridge is inserted into the liquid ejection type recording device.

With the employment of the above described structural arrangement for an ink cartridge, the second ink holding portion which catches and holds the liquid ejected toward slightly outward of the edges of the recording medium, in terms of the primary scanning direction of the liquid ejection head, by the liquid ejection head of a recording apparatus in which the liquid ejection head is shuttled in the direction intersectional to the recording medium conveyance direction, and which is capable of printing across the entire surface of the recording medium, when the recording apparatus is in the borderless mode, becomes an integral part of an ink cartridge. In the case of such an ink cartridge, the ink cartridge is required to contain the absorbent member for absorbing the liquid from the liquid ejection head. Therefore, the ink cartridge becomes long and narrow. Further, the first waste liquid holding portion for catching and holding the liquid discharged from the liquid ejection head also becomes another integral part of the ink cartridge. If the connective portion through which the performance recovery unit is connected to the first waste liquid holding portion is located at the front of an ink container in terms of the direction in which the ink container is inserted into the recording apparatus, as it is in the case of an ink container in accordance with the prior art, the recording apparatus dimension in terms of the primary scanning direction of the liquid ejection head becomes longer by the length equal to the length of the waste ink drain tube which must be placed frontward of the ink container, because of the frontal placement of the connective portion of the ink container. However, according to the above described second aspect of the present invention, the connective portion for the first waste liquid retaining portion is placed rearward of the front end of the ink cartridge in terms of the direction in which the ink cartridge is inserted into the liquid ejection recording apparatus, making it possible to place the waste ink discharge tube on the forward side of the ink cartridge in terms of the recording medium conveyance direction. Therefore, it is possible to deal with the contradiction between the abovementioned two objectives: to reduce recording apparatus size and to increase ink container capacity.

According to a further aspect of the present invention, there is provided an ink cartridge which is detachably mountable to a liquid ejection type recording device including a liquid ejecting head for ejecting liquid onto a recording material while scanning the recording material in a direction crossing with a feeding direction of the recording material, and liquid supplying means for supplying liquid to the liquid ejecting head, said ink cartridge further comprising an absorbing material for absorbing the liquid ejected to an outside of the recording material from the liquid ejecting head; a cap member provided on a side opposite a scanning region of the liquid ejecting head and extended in a direction parallel with the scanning direction of the liquid ejecting head, said cap member having an opening for exposing said absorbing material, wherein said cap member having said opening, including, a first opening region, provided substantially at a center portion thereof, for receiving the liquid from portions at front, rear, both lateral sides in the feeding direction of the recording material; and second opening region and third opening region, provided at end portions so as to interpose said first opening region therebetween, for receiving the liquid from portions at opposite end portions of the recording material, said second opening region and said third opening region having opening areas different from each other.

With the employment of this structural arrangement for an ink cartridge, the hole of an ink cartridge for catching the liquid ejected from the liquid ejection head toward slightly outside of the edges of the recording medium is extended from one end of the ink cartridge to the other in terms of the ink cartridge insertion direction. Therefore, it is possible to provide an ink cartridge which is small relative to the main assembly of a printer, light, and yet capable of efficiently absorbing the liquid ejected from the liquid ejection toward slightly outside of the edges of the recording medium.

According to a further aspect of the present invention, there is provided an liquid ejection type recording device includes a feeding unit for feeding the recording material; a liquid ejecting head for ejecting liquid onto a recording material while scanning the recording material in a direction crossing with a feeding direction of the recording material; a recovery unit for suction discharge of the liquid through a nozzle of the liquid ejecting head; an ink cartridge for accommodating the liquid to be supplied to the liquid ejecting head, wherein said ink cartridge comprises a receiving portion for receiving the liquid discharged from said recovery unit; a liquid containing portion for accommodating the liquid to be supplied to said liquid ejecting head; a connecting portion for connecting said and said recovery unit with each other, said connecting portion is disposed at a position upstream of a front end surface portion of said ink cartridge with respect to an inserting direction in which said ink cartridge is inserted into the liquid ejection type recording device; a tube member for discharging the ink from recovery unit to said receiving portion, wherein said tube member is connected with said connecting portion when said ink cartridge is mounted to said liquid ejection type recording device.

A recording apparatus of this type takes full advantage of the characteristics of an ink cartridge in accordance with the present invention. Therefore, not only is it smaller in size, but also, unlikely to suffer from the internal leakage of waste ink.

According to a further aspect of the present invention, there is provided a manufacturing method for manufacturing an ink cartridge which is detachably mountable to a liquid ejection type recording device including a liquid ejecting head for ejecting liquid onto a recording material while scanning the recording material in a direction crossing with a feeding direction of the recording material, a recovery unit for sucking the liquid through a nozzle of the liquid ejecting head and a liquid containing portion for accommodating the liquid to be supplied to the liquid ejecting head, said manufacturing method comprising a step of preparing an ink cartridge casing which at least partly constitutes the liquid containing portion and which has a recess having an opening in an upper surface adjacent a side surface of the accommodating portion; a step of inserting a second absorbing material into the recess with said opening; a step of placing a first absorbing material on an upper surface of ink cartridge so as to be contacted with said second absorbing material, after said second absorbing material insertion step; a step of forming an ink cartridge of mounting a top cap having an opening on the ink cartridge casing in which said first absorbing material is placed, so that first opening in fluid communication with said first absorbing material is formed in a surface opposite a scanning region of the liquid ejecting head, and a second opening in fluid communication with said second absorbing material is formed in a surface different for the surface having the first opening, wherein a portion in which said second opening is formed is disposed at a position upstream of a front end surface portion of said ink cartridge with respect to an inserting direction in which said ink cartridge is inserted into the liquid ejection type recording device.

According to a further aspect of the present invention, there is provided a manufacturing method for manufacturing an ink cartridge which is detachably mountable to a liquid ejection type recording device including a liquid ejecting head for ejecting liquid onto a recording material while scanning the recording material in a direction crossing with a feeding direction of the recording material, and a recovery unit means for sucking the liquid through a nozzle of the liquid ejecting head, said manufacturing method comprising a step of preparing a receiving portion for receiving the liquid discharged from the liquid ejecting head by the recovery unit; a liquid containing portion for accommodating the liquid to be supplied to the liquid ejecting head; a liquid supply opening for permitting discharge of the liquid from the liquid containing portion to an outside; and a connecting portion for connecting said receiving portion and said suction recovery unit, wherein the connecting portion is disposed at a position upstream of a front end surface portion of said ink cartridge with respect to an inserting direction in which said ink cartridge is inserted into the liquid ejection type recording device; and a step of injecting through said liquid supply opening the liquid to be ejected from said liquid ejecting head.

With the employment of the above described ink cartridge manufacturing methods in accordance with the present invention, it is possible to easily provide an ink cartridge in accordance with the present invention.

These and other objects, features, and advantages of the present invention will become more apparent upon consideration of the following description of the preferred embodiments of the present invention, taken in conjunction with the accompanying drawings.

BEST MODE FOR CARRYING OUT THE INVENTION

Hereinafter, the preferred embodiments of the present invention will be described with reference to the appended drawings.

Embodiment 1

Figure 1:
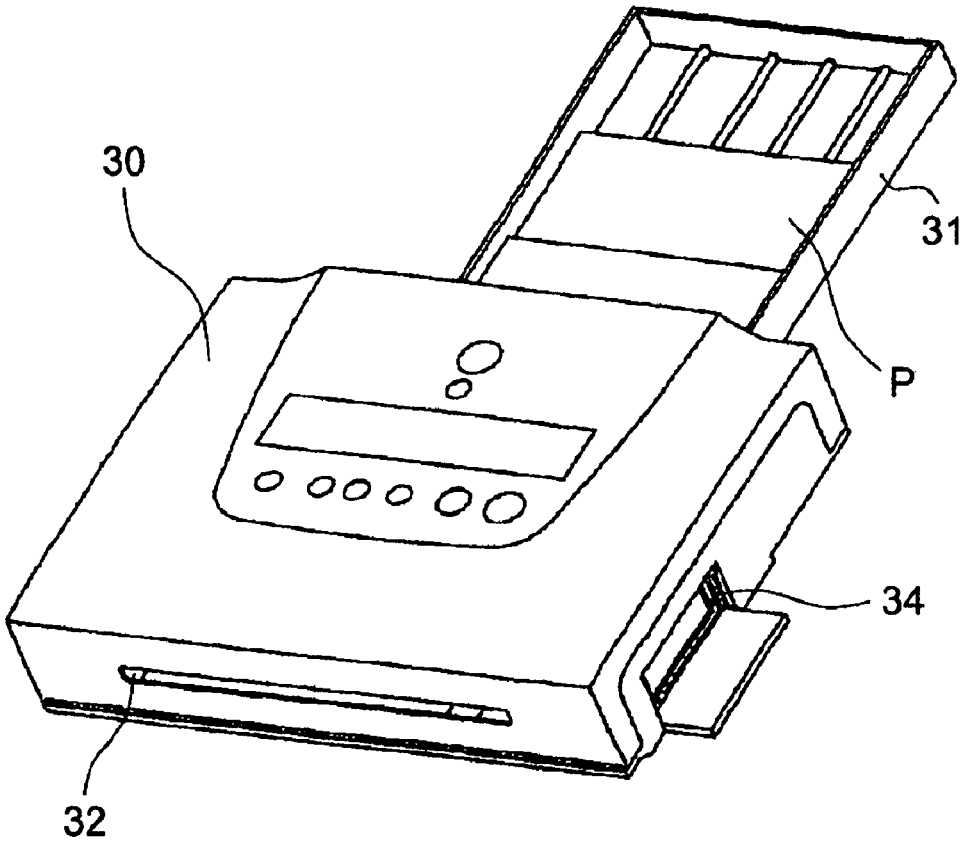
FIG. 1(*a*) is an external perspective view of a typical ink jet printer which employs an ink cartridge in accordance with the present invention, and FIG. 1(*b*) is an internal perspective view of the same., showing the internal structure thereof.
Figure 1:
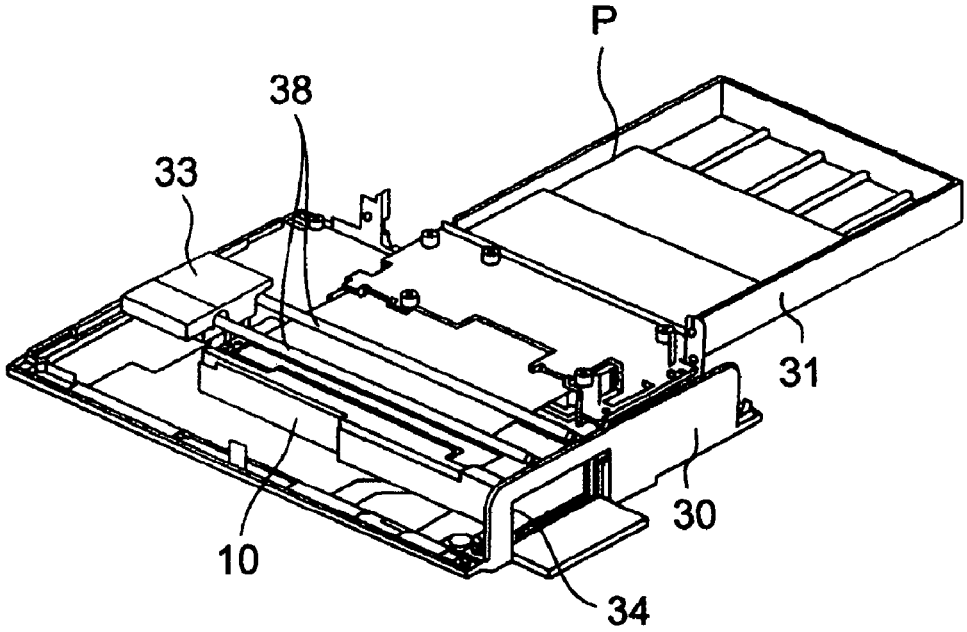
Figure 2:
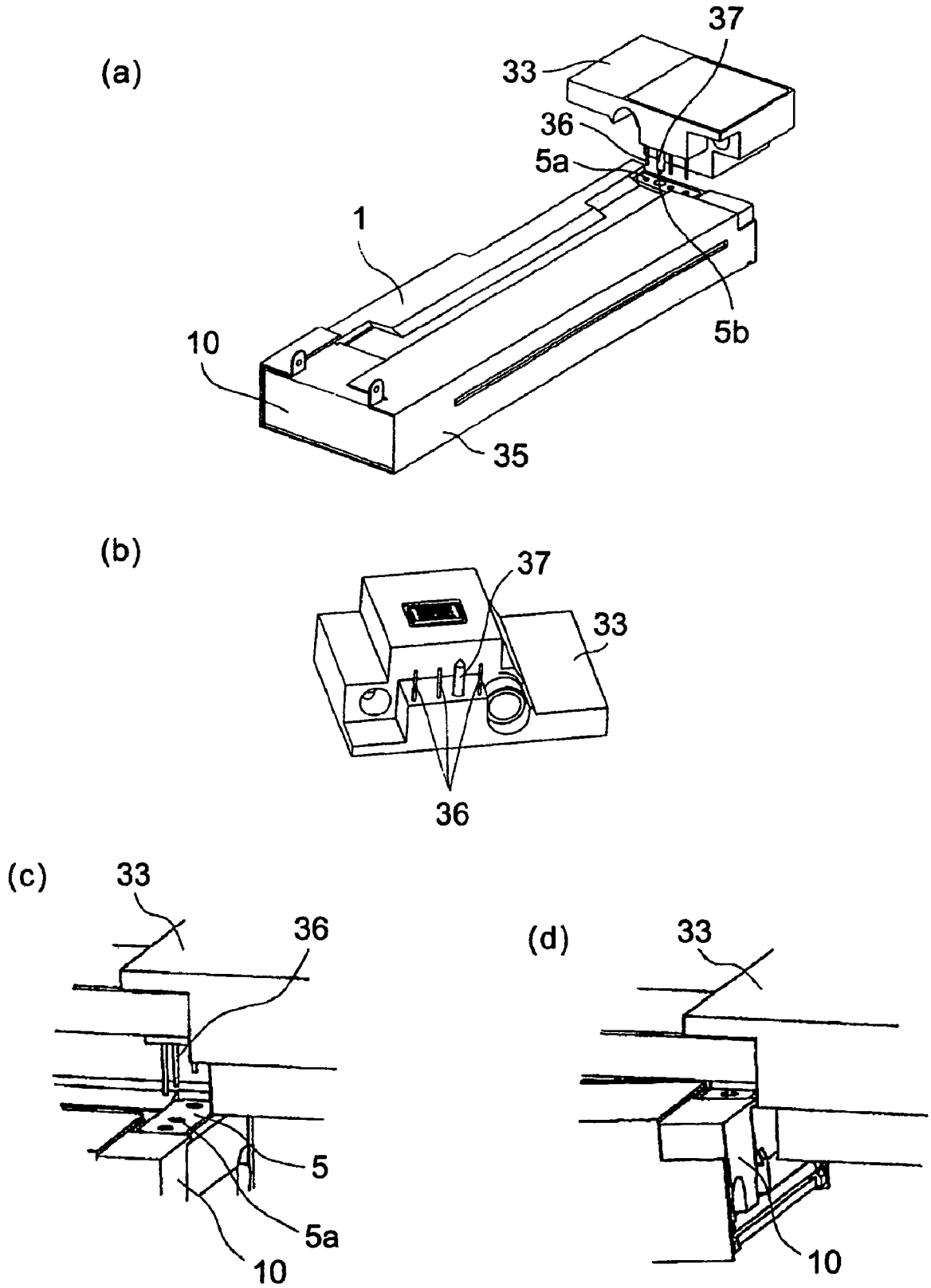
FIG. 2 comprising FIG. 2(*a*) through 2(*d*), is a drawing for describing the ink jet printer shown in FIG. 1, regarding the state of the junction between the connective portion of the ink cartridge and the ink jet head while the ink jet head is supplied with the ink from the ink container.

FIG. 1 is a drawing for depicting a typical ink jet printer which employs an ink cartridge in accordance with the present invention; (a) being an external view, and (b) being a perspective view for showing the internal structure thereof. FIG. 2 is a drawing for depicting how the connective portion of the ink cartridge is connected to the ink jet head of the ink jet printer, shown in FIG. 1, and the state of connection between the two.

Referring to FIG. 1, an ink jet printer 30 is provided with a sheet feeder cassette 31, which is removably mountable in the rear portion of the ink jet printer 30. In the sheet feeder cassette 31, a plurality of sheets of printing paper, which are to be fed into the main assembly of the printer, are stored in layers. Also, the printer is provided with a print delivery hole 32 through which a printed printing paper P is discharged, and which opens at the front end of the printer. After a printing paper P is fed into the printer main assembly, an intended image is printed on the printing paper P by an ink jet head 33, which is supported by a pair of guide rails 38 extended in the direction perpendicular to the direction in which the printing paper P is conveyed, and is reciprocally moved, while ejecting ink. Ink is ejected, that is, pushed out, from each of the plurality of nozzles by the thermal or vibratory energy generated by an unshown heat generating element (or plurality of heat generating elements) or an unshown vibration generating element (plurality of vibratory elements) disposed in the adjacencies of each of the ejection orifices of the ink ejection nozzles.

An ink cartridge 10 for holding recording ink is replaceably mountable in the printer main assembly through an ink cartridge replacement hole 34, which is located in one of the lateral walls of the printer main assembly. After the installation of the ink cartridge 10 into the printer main assembly, it is below the passage through which the printing paper P is conveyed after it is fed into the printer main assembly. In other words, there is an ink cartridge chamber 35 for holding the ink cartridge 10, below the printing paper passage, as shown in FIG. 2. The top wall of the ink cartridge chamber 35, is provided with a hole as the passage between the ink jet head 33 and the ink retaining member for catching and retaining the waste ink from the ink jet head.

Referring to FIGS. 1(*b*) and 2(*a*), provided that the ink cartridge 10 is in the proper position in the ink jet printer, when the ink jet head is in the home position, the cylindrical needle 36 of the ink jet head 33 can be inserted into the connection holes 5*a* of the ink cartridge, which will be described later. Thus, as the ink jet head 33 which ejects ink as described above is joined with the ink cartridge 10 in the ink cartridge chamber 35, the cylindrical needles 36 of the ink jet head 33 which ejects ink as described above, are inserted into the connective holes 5*a* (FIG. 2(*d*)), and the ink in each of the ink pouches in the ink container 10 is introduced by a predetermined amount into the corresponding liquid chamber (unshown) of the ink jet head 33 by the negative pressure generated by a pump (unshown) connected to the ink jet head 33. In order to assure that the cylindrical needles 36 are inserted one for one into the connective holes 5*a*, the ink jet head 33 is provided with a positioning guide pin 37, so that as the positioning guide pin 37 is inserted into the positioning hole 5*b* of the ink cartridge 10, it is assured that the cylindrical needles 36 are accurately positioned relative to the connective holes 5*a*.

Prior to the beginning of the actual printing by the ink jet head 33, the cylindrical needles 36 are pulled out of the connective holes 5*a*. In other words, while the ink jet head 33 is away from this position (home position), and is moved in a manner of scanning the printing paper P to print an image on the printing paper P, there is no contact between the cylindrical needles 36 and ink container 10 (connective holes 5*a*). However, after the completion of a certain amount of a printing job, the ink jet head 33 is returned to the home position, where the cylindrical needles 36 of the ink jet head 33 are again inserted into the connective holes 5*a*, one for one, and the ink in the ink cartridge is drawn by the predetermined amount into the ink jet head 33 by the negative pressure generated by the abovementioned pump, as described above, refilling the ink jet head 33 with ink. In other words, the ink jet head 33 is intermittently returned to the home position for refilling.

In order to repeatedly use this ink recharging system, the insertion of the cylindrical needles 36 of the ink jet head 33 into the joint portion 5, and the removal thereof from the joint portion 5, must be repeated. Thus, the ink cartridge and the printer main assembly are provided with grooves (unshown), and a shaft vertically movable by a cam or the like, respectively, so that as the shaft is vertically moved, the ink cartridge itself is vertically moved, causing thereby the cylindrical needles 36 to be inserted into the connective holes 5*a* of the printer main assembly, or removing the needles 36 from the connective holes 5*a*.

An ink pouch placed in the ink containing portion 3 of the ink cartridge 10 is designed to minimize the ink cartridge 10 in projected area. More specifically, two pieces of film, which are 32 mm in width, 130 mm in length, and 0.1 mm in thickness, are thermally welded to each other to form the ink pouch when the ink pouch is full, its thickness is 3 mm. In order to assure that ink is properly ejected through all ejection orifices of the ink jet head 33, the performance recovery operation is carried out. Thus, in this embodiment, each of the cyan, magenta, and yellow ink pouches is filled with 4.2 mm of ink, which equals the sum of the amount of the ink necessary for the performance recovery operation and the normal amount of ink necessary to complete 50 prints. As a given ink cartridge is depleted of ink, it is replaced with a brand-new cartridge of the same type to continue the interrupted ongoing printing operation.

Figure 3:
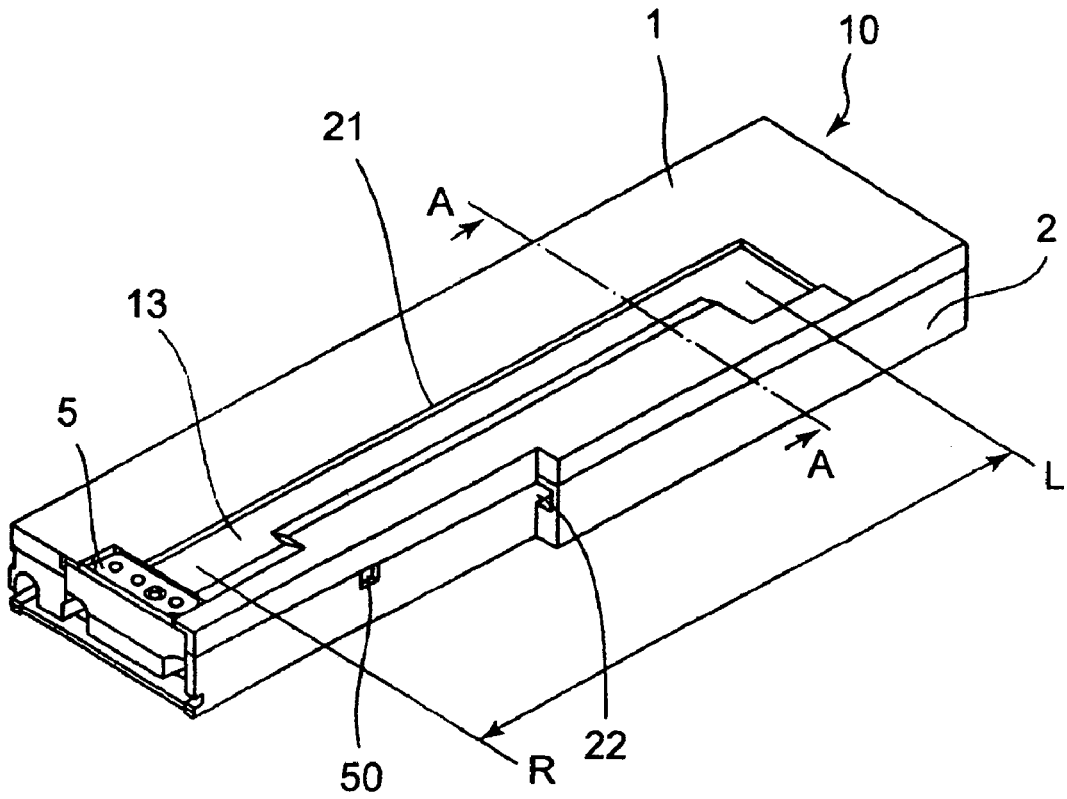
FIG. 3(*a*) is an external perspective view of the ink cartridge in the first embodiment of the present invention, and FIG. 3(*b*) is a cross sectional view of the same, at the line A-A in FIG. 3(*a*).
Figure 3:
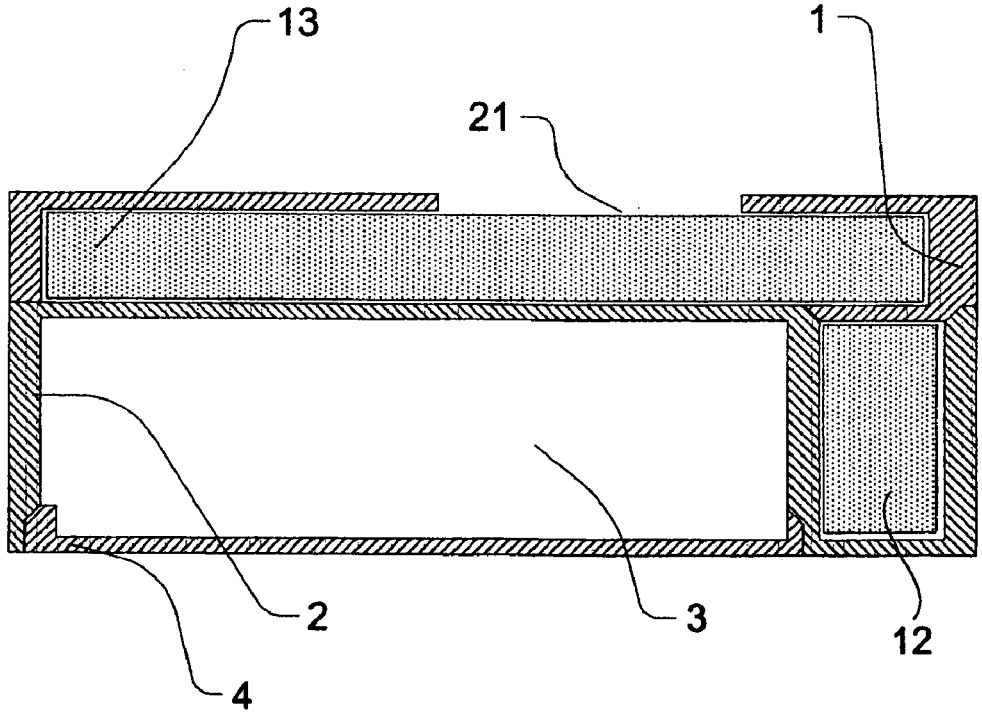

Next, referring to FIG. 3, the ink jet cartridge in accordance with the present invention will be described in detail. FIG. 3(*a*) is an external perspective view of the ink cartridge in the first embodiment of the present invention, and FIG. 3(*b*) is a cross-sectional view of the same, at the line A-A in FIG. 3(*a*), showing the internal structure thereof.

The ink cartridge 10 shown in FIGS. 3(*a*) and 3(*b*) comprises a boxy frame 2, which is in the form of a rectangular parallelepiped. The ink cartridge 10 also comprises a second waste ink catching portion 13, which is on the boxy frame 2 and is virtually sealed with the top lid 1 of the ink cartridge 10. The boxy frame 2 is provided with the ink holding portion 3, which is sealed with the bottom lid 4. Further, the boxy frame 2 is provided with a recess, in which a first waste ink retaining portion 12 is placed, and which is located next to the ink holding portion 3, being virtually sealed by the top lid 1 of the ink cartridge 10.

The ink cartridge 10 also comprises: a first hole 21, which is a part of the top lid 1, that is, the top wall of the ink cartridge 10; and a connective portion 22, which is a part of one of the side walls of the ink cartridge 10. The waste ink, that is, the excess ink ejected from the ink jet head (unshown in FIG. 3) during actual printing, is caught by the second waste ink catching portion 13 through the first hole 21. There is another type of waste ink, that is, the ink suctioned through the ejection orifices of the ink jet head 33 by the performance recovery apparatus (unshown) of the printer main assembly to restore the performance of the ink jet head. This type of waste ink is discharged into the first waste ink retaining portion 12 through the draining system of the printer main assembly comprising a piece of tube or the like, and the connective portion 22 of the ink cartridge 10, In other words, the space formed between the top wall of the boxy frame 2 and the top lid 1 of the ink cartridge 10 constitutes the second waste ink catching portion which catches and retains the liquid ejected toward slightly outside the boundary of the printing medium by the ink jet head, whereas the space formed next to the ink storage portion 3 by one of the side walls of the ink holding portion 3, a part of the top lid 1 of the ink cartridge 10, and one of the side walls of the ink cartridge 10 constitutes the first waste ink retaining portion 12, which retains the ink suctioned out of the ink jet head through the ejection orifices thereof. The first hole 21 of the top lid 1 of the ink cartridge 10 leads to the second waste liquid-retaining portion, or the portion which catches and retains the excess liquid ejected from the ink jet head during the actual printing, whereas the connective portion 22 as a part of one of the side walls of the ink cartridge 10 leads to the first waste ink retaining portion, or the portion which retains the ink suctioned through the ejection orifices of the ink jet head.

The ink storage portion 3 is enabled to hold three ink containers (unshown) in layers, which are filled with cyan, magenta, and yellow inks, one for one, used by the ink jet printer (FIG. 1). These ink containers are in the form of a pouch capable of deforming in response to the drawing of the ink therefrom.

The ink cartridge 10 is removably mountable in the printer main assembly. The lengthwise direction of the ink cartridge 10 roughly matches the direction in which the ink cartridge 10 is inserted into the printer main assembly. It is provided with a joint portion 5, through which the inks, different in color, in the ink containers in the ink storage portion 3 are supplied to the ink jet head, and which constitutes the top front portion of the ink cartridge 10 in terms of the ink cartridge insertion direction.

The joint portion 5 comprises: a plurality (three in this embodiment) of connective holes 5*a* for supplying the ink jet head with ink; and a single (one in this embodiment) positioning hole for accurately positioning the ink jet head when connecting the ink jet head to the ink cartridge 10. Within each of the connective holes 5*a*, a sealing member (unshown) is provided for preventing the ink evaporation while the printer is not in use.

Next, referring to FIG. 4 which depicts the ink cartridge 10 from the ink jet head (unshown) side, and in which the top lid 1 as the top wall of the ink cartridge 10 has been removed, the positional relationship between the first and second waste ink retaining portions 12 and 11 will be described.

As will be evident from FIG. 4, the second ink catching portion 11 is on top of the boxy frame 2, and the first ink catching portion 12 is below the level of the second ink catching portion 11. In FIG. 4, the direction in which the ink cartridge 10 is inserted into the ink jet printer (unshown) is indicated by an arrow mark B. As the ink cartridge 10 is inserted into the ink jet printer, the drain tube 40 of the printer main assembly enters the first ink catching portion 12 through the connective portion 22.

Figure 4:
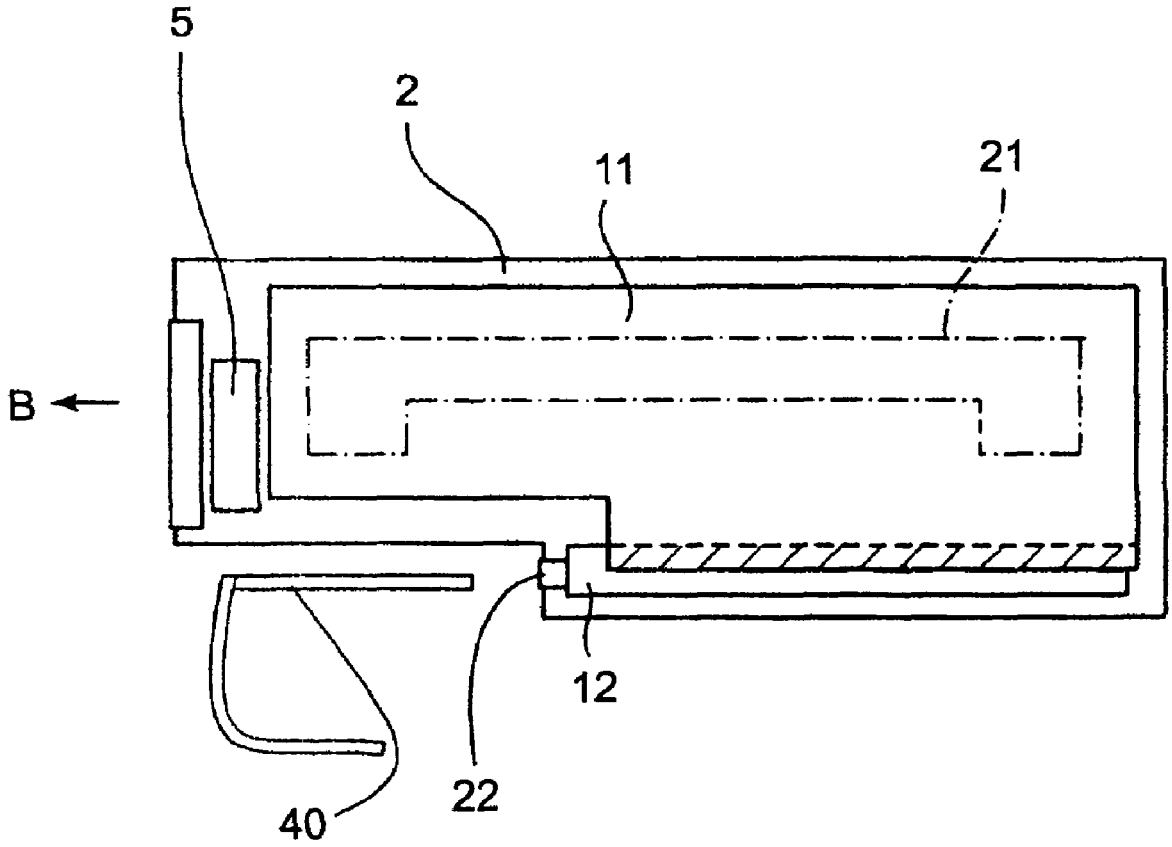
FIG. 4 is a drawing showing the positional relationship between the first and second waste ink retaining members of the ink cartridge in accordance with the present invention.
Figure 5:
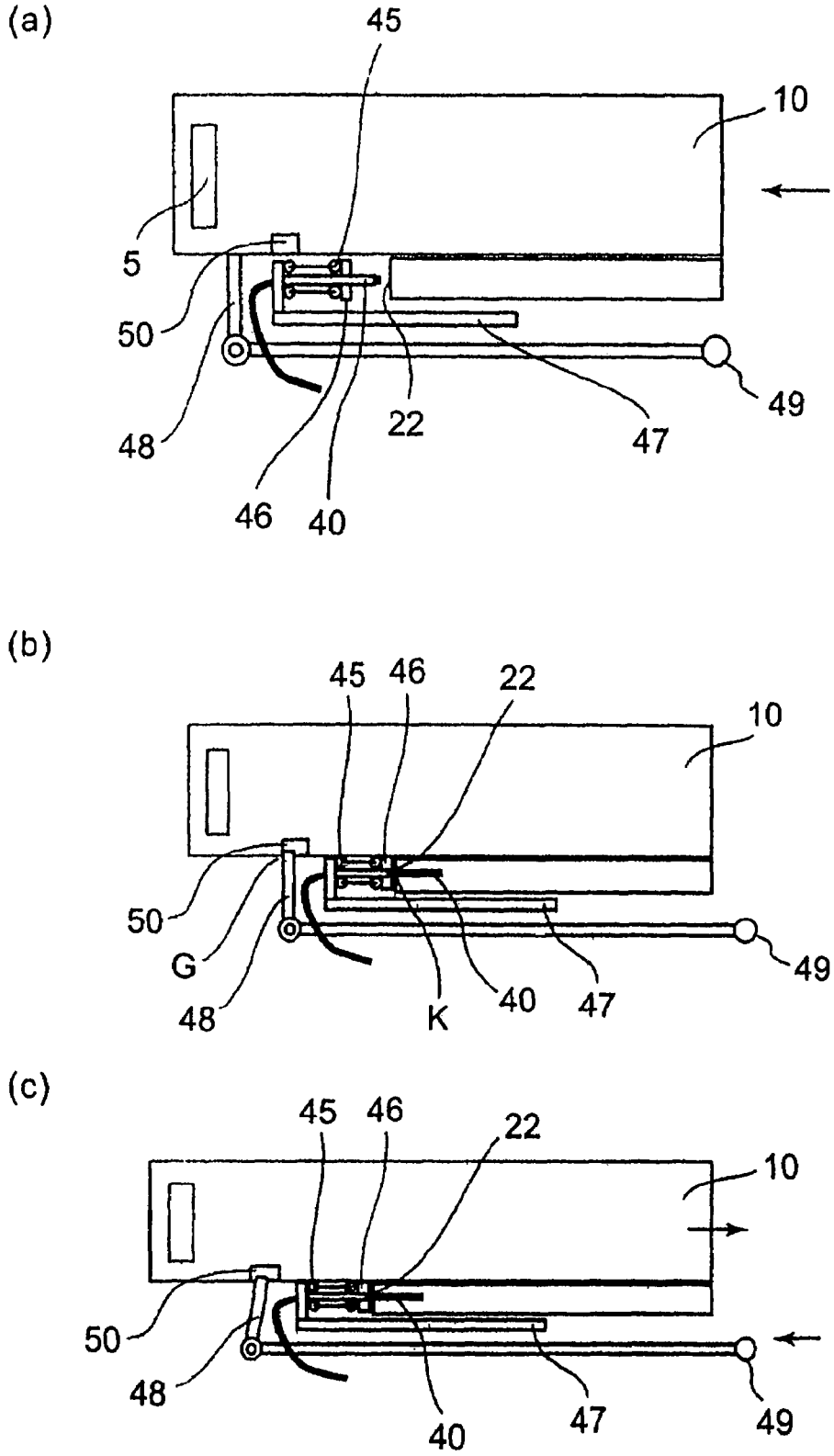
FIGS. 5(*a*)-5(*c*) are top plan views of the ink cartridge in accordance with the present invention, and its adjacencies, in the printer main assembly, showing what occurs as the ink cartridge is inserted into, or removed from, the printer main assembly, and the positioning of the ink container in the printer main assembly.

Also as shown in FIG. 4, the opening of the connective portion 22, through which the drain tube 40 enters the first ink catching portion 12, is not at the front end of the ink cartridge 10 in terms of the ink cartridge insertion direction; it is located at a point approximately corresponding to the mid point of the first ink catching portion 11 in terms of the ink cartridge insertion direction. This structural arrangement makes it possible to position the drain tube 40 on the frontward side of the ink cartridge 10 in terms of the direction in which the recording medium is conveyed, making it thereby possible to reduce the dimension of the ink jet printer 30 in terms of the direction in which the carriage is reciprocally moved. In particular, the ink jet printer in this embodiment is structured so that the recording head is connected to the ink cartridge 10 only when it is necessary for the recording head to be supplied with ink. Therefore, a recording apparatus such as the one in this embodiment needs to be equipped with a mechanism for connecting the recording head to the ink cartridge only when the connection is necessary. In this embodiment, therefore, the ink jet printer is structured (FIGS. 2(*c*) and 2(*d*)) so that the ink cartridge is rotated about its rear end in terms of the cartridge insertion direction, in order to connect the ink cartridge to the recording head. This structural arrangement of placing the connective portion at a rearward point of the ink cartridge in terms of the ink cartridge insertion direction, as in this embodiment, offers an extra effect of preventing the mechanism for rotating the ink cartridge, from interfering with the drain tube, making it thereby easier to lay the drain tube around the printer main assembly, and also, reducing the load upon the drain tube. The ink cartridge in this embodiment is also provided with a recess 50, into which a pin for locking in position the ink cartridge in the printer main assembly fits. The recess 50 is between the front end and the connective portion of the ink cartridge, in terms of the cartridge insertion direction. This positional relationship is not mandatory for obtaining the above described effects, but is effective for additional size reduction. Next, referring to FIG. 5, what occurs as the ink cartridge is inserted into the printer main assembly will be described in more detail. FIG. 5 is a top plan view of the ink cartridge in this embodiment, showing how the ink cartridge is positioned relative to the printer main assembly, and how the ink cartridge is mounted into, or removed from, the printer main assembly. Referring to FIG. 5, the wall of the ink cartridge 10, which comprises the connective portion 22, is located rearward of the front end of the ink cartridge 10 in terms of the direction in which the ink cartridge 10 is inserted into the printer main assembly, as described above. In the initial stage (FIG. 5(*a*)) of the insertion of the ink cartridge 10 into the printer main assembly, the connective portion 22 faces the tip of the drain tube 40. The drain tube 40 is supported by the guide frame 47 in the printer main assembly. The drain tube 40 is fitted with a spring seat 46, which is on the tip side of the drain tube, being kept pressed toward the tip of the drain tube by the elastic member (spring) 45. The aforementioned recess 50 (FIG. 3(*a*)) for keeping the ink cartridge 10 properly positioned in the printer main assembly is a part of the left side wall of the ink cartridge 10, in terms of the cartridge insertion direction, being located between the front end of the first waste ink retaining portion 12 (FIGS. 3(*b*) and 4), which comprises the connective portion 22 into which the drain tube for discharging the waste ink is inserted. In other words, the recess 50 is on the forward side of the wall of the ink cartridge 10 having the connective portion 22. The printer main assembly is provided with a latch 48, in the form of a pin, which engages into the recess 50 of the ink cartridge 10 to lock the ink cartridge 10 in position, as the ink cartridge 10 is inserted into the predetermined position (FIG. 5(*b*)) in the printer main assembly. The engagement between the latch 48 and recess 50 can be dissolved by pressing the release lever 49 of the printer assembly in the cartridge insertion direction. In other words, as the release lever 49 is pushed in the direction indicated by an arrow mark in FIG. 5(*c*), the latch 48 engaged in the recess 50 is pivoted about the supporting shaft thereof, being tilted in the direction opposite to the cartridge insertion direction so that it comes out of the recess 50.

Next, referring to FIG. 5, how the ink cartridge 10 is positioned relative to the printer main assembly, how the ink cartridge 10 is mounted into the printer main assembly, and how the ink cartridge 10 is removed from the printer main assembly, will be described.

As the ink cartridge 10 is inserted deeper into the printer main assembly (FIG. 5(*a*)), the drain tube 40 supported by the guide fame 47 of the printer main assembly is inserted into the waste ink retaining member (unshown) in the first waste ink retaining portion 12 through the connective portion 22 of the ink cartridge 10. Further, as the ink cartridge 10 is inserted, the elastic member (spring) 45 is compressed by the wall of the ink cartridge 10 having the connective portion 22 through the elastic member (spring) seat 46. Thus, the force (reactive force) generated by the compressed elastic member 45 acts in the direction to push the wall of the ink cartridge 10 having the connective portion 22 in the direction opposite to the cartridge insertion direction. As the ink cartridge 10 is further inserted into the printer main assembly, with the latch 48 of the printer main assembly sliding on the side wall of the ink cartridge 10, the latch pin 48, in the form of a pin, of the printer main assembly fits into the recess 50 (Point G), preventing the ink cartridge 10 from being inserted further (FIG. 5(*b*)). At this point (Point K), the elastic member (spring) seat 46 is in contact with the wall of the ink cartridge 10 having the connective portion 22, with the elastic member (spring) seat 46 remaining in contact with the wall of the ink cartridge 10 having the connective portion 22. When the ink cartridge 10 is in this position, the elastic member (spring) 45 is in the compressed state, and the drain tube 40 has fully entered the first waste ink retaining portion 12 of the ink cartridge 10 (FIGS. 3(*b*) and 4). In other words, this is the point at which the mounting of the ink cartridge 10 into the ink jet printer is end. On the other hand, when it is necessary to remove the ink cartridge 10 from the ink jet printer, the release lever 49 is to be pushed in the direction indicated by an arrow mark, as shown in FIG. 5(*c*). As the release lever 49 is pushed, the pin-shaped latch 48 engaged in the recess 50 of the ink cartridge 10 is moved out of the recess 50. In other words, the pin-shaped latch 48 becomes disengaged from the ink cartridge 10, allowing the ink cartridge 10 to be moved in the direction indicated by an arrow mark (direction opposite to cartridge insertion direction), that is, in the direction to be pushed out of the printer main assembly, by the resiliency of the elastic member (spring) 45, which acts on the wall of the ink cartridge 10 having the connective portion 22 through the spring seat 46. As a result, the ink cartridge 10 moves in the direction to be pushed out of the ink jet printer, in the direction opposite to the cartridge insertion direction, becoming ready to be pulled out of the ink jet printer. As described above, the recess 50 of the ink cartridge 10 into which the latch of the printer main assembly latches, is located forward of the wall of the ink cartridge 10 having the connective portion 22 in terms of the ink cartridge insertion direction. Therefore, the space in the form of a rectangular parallelepiped extending from the wall of the ink cartridge 10 having the connective portion 22 to the front end of the ink cartridge 10, in terms of the cartridge insertion direction, can be utilized as the space for accommodating the mechanism, on the printer main assembly side, to be activated to facilitate the mounting of the ink cartridge 10 into the printer main assembly or the dismounting of the ink cartridge 10 therefrom. In other words, the mechanism for facilitating the mounting or dismounting of the ink cartridge 10 can be fitted in this space. Therefore, the main assembly of the ink jet printer does not need to be increased in size to accommodate the ink cartridge 10.

Figure 6:
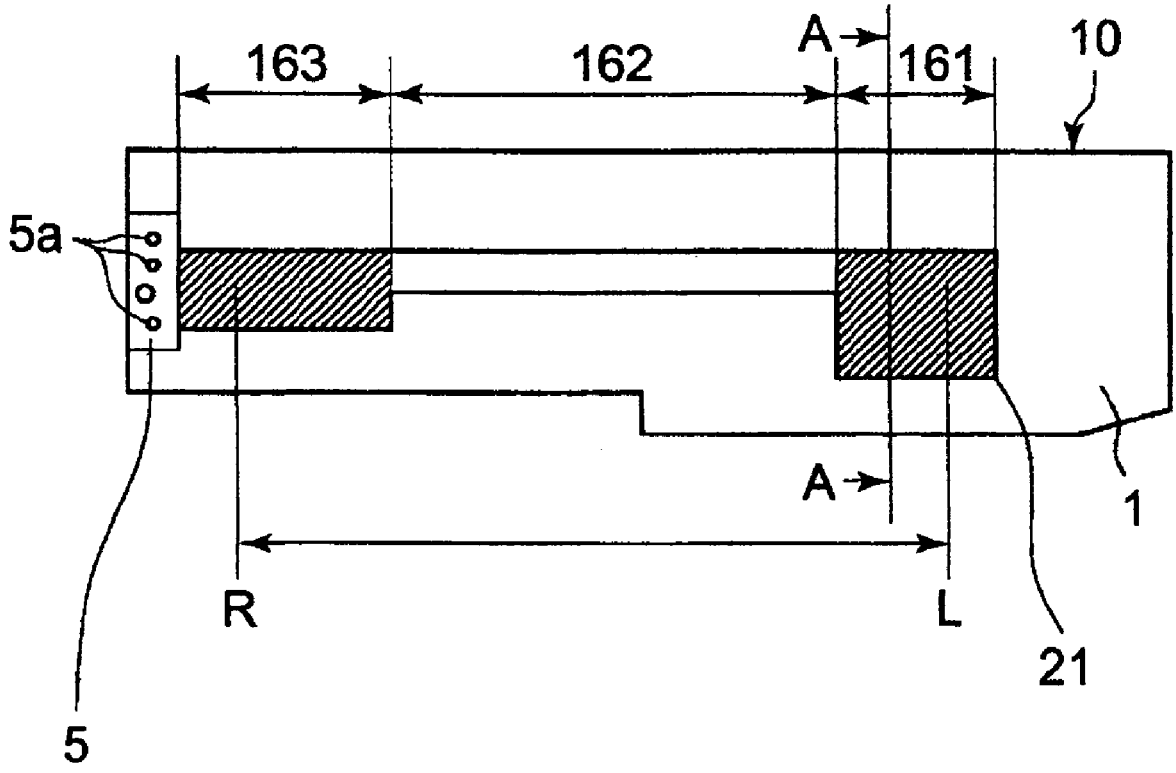
FIG. 6 is a top plan view of the ink cartridge shown in FIG. 3.

Next, the first hole 21 and connective portion 22 of the ink cartridge 10 in this embodiment will be described in more detail. FIG. 6 is a top plan view of the ink cartridge shown in FIG. 3. As printing is started, the ink jet head ejects ink toward the first hole 21 of the ink cartridge 10, which faces the ink jet head, through the hole of the ink cartridge chamber (FIG. 2(*a*)). As for the movement of the ink jet head, the ink jet head is shuttled within the range R-L indicated by a two-headed arrow. The recording paper on which printing is done is fed in the direction (secondary scanning direction) roughly perpendicular to the direction indicated by the two-headed arrow. In other words, the range R-L is the ink ejection range of the ink jet head. With the provision of this setup, in order to produce a borderless print, that is, to cover the entire surface of the recording medium with an image, the ink jet head is activated in the following manner. That is, in terms of the recording medium conveyance direction, the ink jet head is made to begin printing, that is, ejecting ink, slightly before the recording medium reaches the printing track of the ink jet head, and to continue to print, that is, eject ink, until slightly after the trailing edge of the recording medium passes the printing track of the ink jet head. In terms of the shuttling direction of the ink jet head, that is, the direction roughly perpendicular to the recording medium conveyance direction, the ink jet head is made to begin printing action slightly before it reaches one edge of the recording medium, from the outward of the recording medium, and to continue printing action until slightly after it passes the other edge of the recording medium. Thus, during a borderless printing operation, the ink ejected toward slightly outside the range of the recording medium, in other words, excess ink, and/or the mist effected by such ink, adheres to the ink cartridge 10, unless it is prevented from doing so. Thus, in order to prevent the above described excess ink from directly adhering to the top lid 1 of the ink cartridge 10, the top lid 1 is provided with the first hole 21. As it is well-known, in order to recover the performance of the ink jet head after the ink jet head is kept inactive for a long period of time, or to prevent the color mixture, the ink jet head must periodically be made to eject ink (preparatory ejection) without the presence of the recording medium, as a part of a maintenance operation. This is another reason the top lid 1 of the ink cartridge 10 is provided with the first hole 21; in other words, the first hole 21 is provided to prevent the ink ejected for maintenance from directly adhering to the top lid 1 (right and left end portions of the first hole 21 in FIG. 3(*a*)). Thus, the position, size, shape, and number of first hole 21 are decided in consideration of the factors which affect the catching and retaining the excess ink (inclusive of ink mist), or the waste ink, generated during a borderless printing operation, and the factors which affect the catching and retaining the waste ink generated by preparatory or maintenance ink ejection. In terms of the secondary scanning direction, the first hole 21 needs to be roughly as wide as the pitch at which the recording medium is moved in the secondary scanning direction. Further, in a borderless printing operation, ink is ejected even slightly outside the range of the recording medium. In other words, in reality, the range, in terms of the recording medium conveyance direction, in which ink is ejected is slightly wider than the pitch at which the printing paper is conveyed. Therefore, its width is slightly greater than the distance a recording medium is advanced per conveyance. On the other hand, in terms of the primary scanning direction, the dimension of the first hole has only to be as wide as the length of the line of the ink ejection nozzles of the ink jet head. In the case of a recording paper of an A4 size, or the most commonly used recording paper, the length of its shorter edge is roughly 210 mm. Thus, when an A4 size recording paper is fed into the printer main assembly so that it long edge becomes parallel to the recording medium conveyance direction, 210 mm is the width of the recording medium in terms of the primary scanning direction. On the other hand, the dimension of each of the lines of the ink ejection orifices in terms of the secondary scanning direction is roughly 25.4 mm. Further, the ink jet head in this embodiment has three lines of ejection orifices: a line of magenta ink ejecting orifices, a line of cyan ink ejecting orifices, and a line of yellow ink ejecting orifices, which extend in parallel in the direction perpendicular to the primary scanning direction. The distance between the two outward lines of ejection orifices is roughly 5.42 mm. Thus, if an ink jet printer is structured so that the ink cartridge is placed below the above described platen, the area which the ink jet head covers as it moves from one end of its moving range to the other when the ink jet printer is in a borderless printing mode becomes rectangular, and its minimum size is roughly several hundreds of millimeters, in terms of the primary scanning direction, which roughly equals the aforementioned width of the recording medium, and several tens of millimeters in terms of the secondary scanning direction. In this embodiment, the first hole 21 is an integral combination of the left and right end portions created by widening the lengthwise end portions of the hole 21 in the recording medium conveyance direction (direction in which recording medium is conveyed) in order to catch the ink from the ink jet head when the ink jet head is slightly outside the range of the recording medium, and the center portion (range R-L) for catching the excess ink, that is, the ink ejected slightly ahead of the arrival of the leading edge of the recording medium, or slightly after the arrival of the trailing edge of the recording medium. Referring to FIG. 6, the printer in this embodiment uses the left (L) side of the printer as the reference side, relative to which the position of the recording medium in terms of the direction perpendicular to the recording medium conveyance direction is set. Therefore, in order to accommodate plural types of printing media (recording media) different in size, the right end portion 163 of the first hole 21 is made longer than the left end portion 161 of the first hole 21, in terms of the primary scanning direction of the ink jet head. Further, the ink jet printer in this embodiment is structured so that the preparatory ejection is done when the ink jet head is opposing the end portion 161, or left end portion, of the first hole 21. Further, the amount, by which ink mist is generated by the air flow induced during the ejection sequence and/or the reciprocal movement of the ink jet head, is greater on the end portion 161 of the first hole 21, because not only is the preparatory ejection is done when the ink jet head is in the range of the end portion 161, or the left end, of the first hole 21, but also, after the completion of the mounting of the ink container into the printer main assembly, the rear end of the ink cartridge, in terms of the ink cartridge insertion direction, is very close to the wall of the printer main assembly due to the internal structure of the printer main assembly. Therefore, the end portion 161 of the first hole 21 is made wider than the center portion 162 and right end portion 163, in terms of the recording paper conveyance direction.

As described above, the ink cartridge in this embodiment of the present invention is employed by a printer capable of producing a borderless print, and is mounted into the printer main assembly so that the top wall of the ink cartridge faces the area which the ink jet head covers as it moves from one end of its moving range to the other. It is provided with the ink retaining member for absorbing and retaining the ink discharged during a head performance recovery operation. It is characterized in that, in order to expose the waste ink retaining member, the wall of the ink cartridge facing the ink jet head is provided with the first hole comprising: the center portion for catching the excess ink (inclusive of ink mist) which results while printing on the leading and trailing edge portions of the recording medium, in terms of the printing medium conveyance direction, when the ink jet printer is in the borderless mode; and the end portions for catching the ink ejected during the preparatory ejection, and the ink ejected when the ink jet head is slightly outside the range of the recording medium in terms of the primary scanning direction. In other words, the first hole through which the waste ink is caught and retained by the waste ink retaining member is extended from slightly outside of one edge of the recording medium to the slightly outside of the other edge in terms of the primary scanning direction of the ink jet head. Therefore, the ink cartridge in this embodiment is small and light, and yet, superior in terms of the efficiency with which waste ink (inclusive of excess ink and ink mist) is absorbed. Obviously, it is no higher than an ink cartridge in accordance with the prior art, in terms of the cost for absorbing the above described waste ink. Further, it does not require that the ink jet printer main assembly be increased in size, in proportion to the increase in the volume of the waste ink, in consideration of the length of the service life of the ink jet printer.

Embodiment 2

Figure 7:
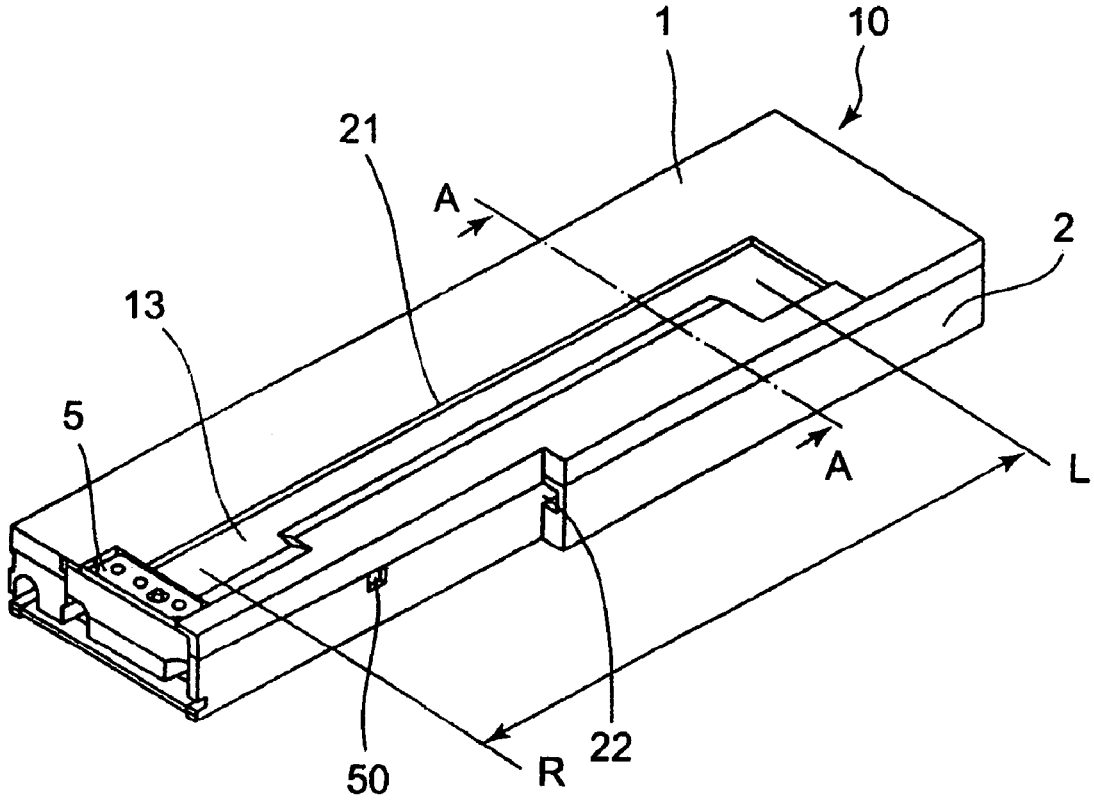
FIG. 7(*a*) is an external perspective view of the ink cartridge in the second embodiment of the present invention, and FIG. 7(*b*) is a cross sectional view of the same at the line A-A in FIG. 7(*a*).
Figure 7:
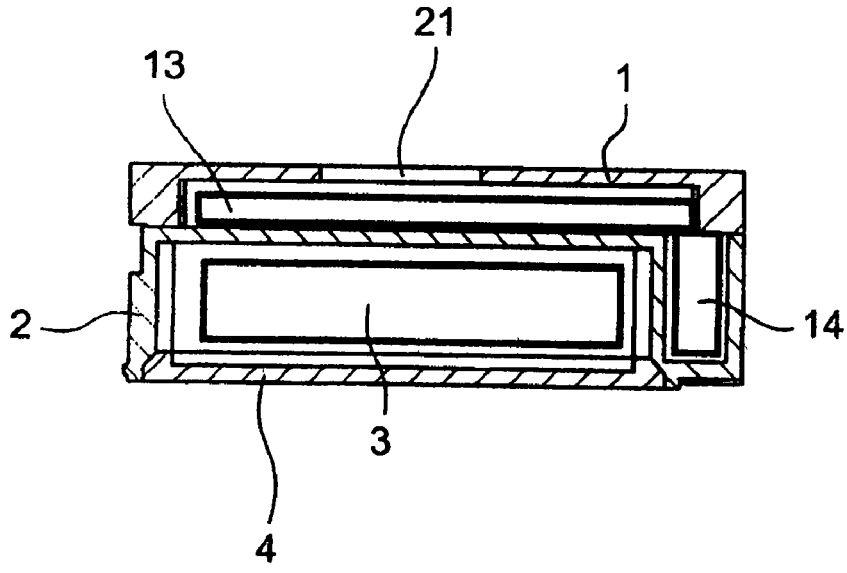

Next, the second embodiment of the present invention will be described. FIG. 7(*a*) is an external perspective view of the ink cartridge in the second embodiment of the present invention, and FIG. 7(*b*) is a cross-sectional view of the ink cartridge shown in FIG. 7(*a*), showing the internal structure thereof at the line A-A in FIG. 7(*a*). The portions of the ink cartridge in this embodiment similar in functions as those in the first embodiment will be given the same referential symbols as those in the first embodiment, and will not be described here. As is clear in FIG. 7(*b*), in this embodiment, the portion for catching the ink ejected onto the area outside the range of a recording medium and the portion for catching the ink discharged for performance recovery are directly connected to each other. More specifically, this second embodiment is different from the first embodiment in that the second waste ink retaining member 13 in the second waste ink retaining portion 11 is in connection with the first waste ink retaining member 14 in the first waste ink retaining portion 12. Thus, the waste ink retaining portions of the ink cartridge in this embodiment will be described in more detail.

The second waste ink retaining member 13 and first waste ink retaining member 14 are formed of multilayer material comprising a plurality of nonwoven fabrics made mainly of pulp and a plurality of nonwoven fabrics made of synthetic fibers. The second waste ink retaining member 13 is formed mainly of pulp. It is roughly 0.2 g/cm$^3$ in density, 30 mm in width, 130 mm in length, and 3 mm in thickness. It is capable of absorbing roughly 10 ml of ink. On the other hand, the first waste ink retaining member 14 is 0.1 g/cm$^3$ in density, 9 mm in width, 45 mm in length, and 4 mm in thickness. It is capable of absorbing roughly 1 ml of ink. Obviously, the second waste ink retaining member 13, that is, the ink retaining member which faces the ink jet head, is made higher in density than the first waste ink retaining member 14. The two waste ink retaining members are roughly the same in fiber diameter. Therefore, the second waste ink retaining member 13 is greater in capillary force than the first waste ink retaining member 14. Therefore, ink is prevented from flowing backward from the second waste ink retaining member 13, which is capable of retaining a greater amount of ink than the second waste ink retaining member 14, to the first waste ink retaining member 14; in other words, the ink retaining members held in a small cartridge are better utilized. Although in this embodiment, both the first and second waste ink retaining members 14 and 13 are formed mainly of pulp, they may be formed mainly of fibers of such resin as polypropylene or polyethylene which are $2\times10^{-1}$ mm and $6\times10^{-1}$, respectively. Further, all that is necessary in order to prevent ink from flowing from the second ink retaining portion to the first ink retaining portion is to make the second waste ink retaining member 13 smaller in fiber diameter than the first waste ink retaining member 14 while equalizing the two waste ink retaining portions in the density of the ink retaining members therein. In other words, all that is necessary to prevent ink from flowing from the second waste ink retaining portion 12 to first waste ink retaining portion 11 is to make the second waste ink retaining member greater in capillary force than the first waste ink retaining member, regardless of the fiber diameter and density of the two ink retaining members. From the standpoint of the ink dispersion speed, the capillary force of the second waste ink retaining member is desired to be twice that of the first waste ink retaining member.

As the ink cartridge 10 is mounted into the printer main assembly, the drain tube (unshown) for draining the ink suctioned from the nozzles to assure the reliability of the ink jet head 33 in terms of ink ejection is inserted into the first waste ink retaining member 14. As the drain tube is inserted into the first waste ink retaining member 14, the ink having been retained in the first waste ink retaining member 14, it is quickly absorbed into the second waste ink retaining member 13 without flowing back into the drain tube, because of the difference in capillary force between the second waste ink retaining member 13 (greater in capillary force than first waste ink retaining member 14) in contact with the first waste ink retaining member 14. After the mounting of the ink cartridge 10 into the printer main assembly, the drain tube is left inserted in the first waste ink retaining member, preventing thereby ink from leaking out of the cartridge through the drain tube, by the difference in their attitude, until the ink cartridge 10 is removed from the printer main assembly.

Figure 8:
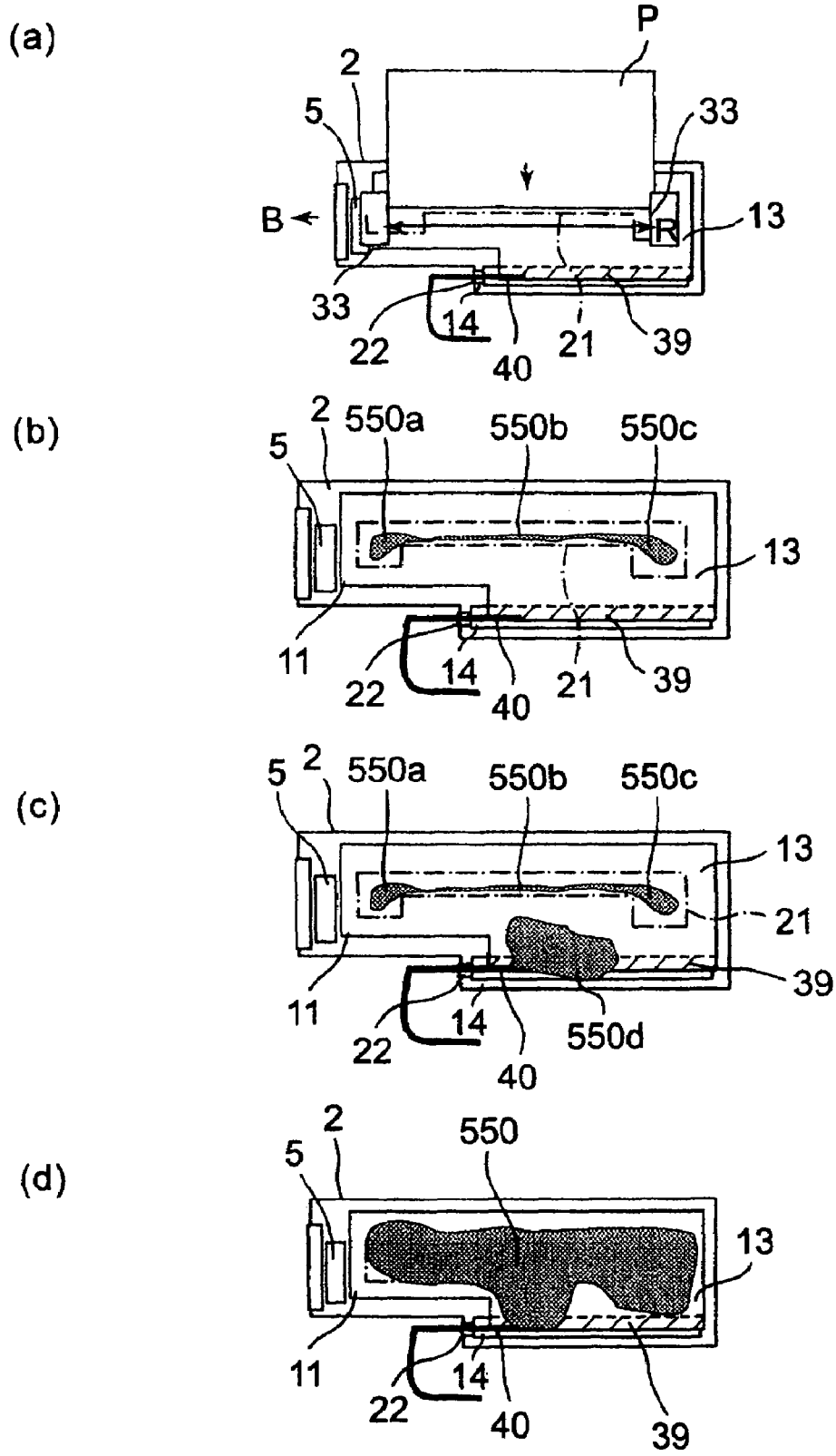
FIGS. 8(*a*)-8(*d*) are top plan views of the ink cartridge in the second embodiment, showing the ink dispersion in the ink retaining member in the ink cartridge.

Next, referring to FIG. 8, the dispersion of ink within the waste ink retaining members in the ink cartridge after the mounting of the ink cartridge into the ink jet printer in this embodiment will be described in detail. Referring to FIG. 8(*a*), as the ink cartridge is inserted into the printer main assembly in the direction indicated by an arrow mark B, the drain tube 40 for discharging the waste ink from the ink jet head of the printer is inserted into the first waste ink retaining member 14 through the connective portion 22. Then, as printing is started, ink is ejected by the ink jet head 33 toward the first hole 21 of the ink cartridge, which the ink jet head 33 faces, with the platen positioned between the ink jet head 33 and first hole 21, in terms of the direction perpendicular to the platen. The ink jet head 33 is shuttled within the range R-L indicated by a two-headed arrow mark in the drawing. The printing medium P on which printing is to be done is moved in the printer main assembly in the direction virtually perpendicular to the direction of the range R-L. The range R-L is the range in which the ink jet head is shuttled while ejecting ink in the direction perpendicular to the printing medium conveyance direction. When the ink jet printer is in the borderless mode, that is, when covering the entire surface of the printing medium P with an image, not only is ink ejected toward the printing medium P, but also, toward slightly outside the leading and trailing edges of the printing medium P, in terms of the printing medium conveyance direction, and also, toward slightly outside the two edges of the printing medium P, in terms of the primary scanning direction of the ink jet head. Thus, the ink ejected toward slightly outside the edges of the printing medium P, and resultant ink mist, becomes the waste ink. This waste ink, and the waste ink resulting from the maintenance of the ink jet printer, for example, preparatory ejection, are absorbed into the second waste ink retaining member 13 through the first hole 21. FIG. 8(*b*) shows how the above described waste ink created when the ink jet printer is in the borderless mode, and the waste ink resulting from the maintenance ejection such as preparatory ejection, are absorbed into the second waste ink retaining member 13. As shown in FIG. 8(*b*), the end portions of the second ink retaining portions 13, in terms of the primary scanning direction of the ink jet head, provided for catching both the waste ink resulting from the preparatory ink ejection, and the ink ejected toward slightly outside the two edges of the printing medium, in terms of the primary scanning direction of the ink jet head, is greater than the center portion of the second ink retaining portion 13, in terms of the amount of the ink ejected thereon. Therefore, they are greater in the speed at which ink disperses through them than the center portion. In other words, in the end portions, ink disperses as indicated by referential symbols 550*a* and 550*c*. In comparison, the center portion of the second waste ink retaining member 13, which catches the waste ink resulting from the ink ejected toward slightly outward of the leading and trailing edges of the printing medium, in terms of the printing medium conveyance direction, is smaller in the amount of the ink it catches than the end portions thereof, because the amount of this type of waste ink is smaller, and the preliminary ejection is sometimes not done. Therefore, the center portion of the second waste ink retaining member 13 is smaller in the amount of the ink it catches, that is, the amount of the ink which disperses therein. Thus, if a large number of prints are continuously produced, the amount of ink in the areas 550*a* and 550*c* in the end portions, respectively, of the ink retaining member 13 is likely to become substantially greater than that in the area 550*b* in the center portion of the ink retaining member 13. In addition, the ink suctioned from the ink jet head of the ink jet printer and discharged into the first waste ink retaining portion 14 is absorbed into the areas 550*a* and 550*c* through the first waste ink retaining member 14, exacerbating the above described condition of the second waste ink retaining member 13. For this reason, if the second waste ink retaining member 13 is insufficiently absorbent, for example, if the ink, which was initially discharged after an ink jet printer had been in storage for a long time, has solidified on and in the second waste ink retaining member 13, the second waste ink retaining member 13 may fail to fully absorb the waste ink. In order to avert this situation, the present invention structures an ink cartridge so that the wall of the ink cartridge having the connective portion 22 is positioned rearward of the front end of the ink cartridge in terms of the direction in which the ink cartridge is inserted into the printer main assembly; the wall with the connective portion 22 is desired to be positioned roughly in the middle of the range of the second waste ink retaining member 14, in terms of the ink container insertion direction. How the excess ink from the ink jet head 33, and the ink discharged from the drain tube 40, are absorbed into the waste ink retaining members and dispersed therein is shown in FIGS. 8(*c*) and 8(*d*).

More specifically, FIG. 8(*c*) shows that the ink 550*d* discharged from the drain tube 40 is absorbed by the first waste ink retaining member 14 in the ink container, which is in the condition shown in FIG. 8(*b*), and dispersed therein. This dispersion reaches the second waste ink retaining member 13. Thus, as the ink discharge from the drain tube 40 is repeated, the ink 550*d* from the drain tube 40 disperses further into the second waste ink retaining member 13, toward the center portion thereof. Eventually, the ink 550*d* disperses in a pattern indicated by an arrow mark 550 in FIG. 8(*d*). In other words, the waste ink resulting from the out-of-boundary ejection, waste ink resulting from preparatory ejection, and waste ink from the discharge ink drain, are more or less evenly dispersed throughout the second waste ink retaining member 13, even to the corner sections. The total of the amounts of these waste inks can be simply estimated by subtracting the capacity of the ink pouch(es) in the ink cartridge from the amount of the ink(s) actually usable for printing (amount of printing ink). Thus, all that is necessary in order to prevent the ink leakage from the ink cartridge is to give the waste ink absorbing portion an ink capacity, in terms of the amount of the ink it can absorb, of no less than this estimation of the total amount of waste ink. As described above, in this embodiment, the wall of the ink cartridge, which faces the liquid ejection head, is provided with the first hole through which the second waste ink retaining member is exposed, in order to catch by the second waste liquid retaining member the waste liquid resulting from the out-of-boundary ejection when an ink jet printer is in the borderless mode. On the other hand, the waste liquid which results because liquid is suctioned through the ejection orifices of the liquid ejection for the maintenance of the liquid ejection head is discharged into the first waste liquid retaining member through the connective portion. In this embodiment, however, the first waste liquid retaining member is placed in contact with the second waste liquid retaining member. Therefore, it is possible to make the waste liquid discharged into the first waste liquid retaining member to be absorbed into the second waste liquid retaining member. Further, the material for the second waste liquid retaining member is made greater in capillary force than that for the first waste liquid retaining member. Therefore, the waste liquid is efficiently absorbed into the second waste liquid retaining member. Further, when a liquid-jet printer structured so that its liquid ejection head is shuttled in the direction perpendicular to the direction in the recording medium is conveyed is in the borderless mode, the waste liquid resulting from the out-of-boundary ejection, in terms of the primary scanning direction of the liquid-jet head is caught by the lengthwise end portions of the waste liquid retaining portion. Since a liquid cartridge (ink cartridge) is designed in consideration of the above described configuration of the waste liquid retaining members for absorbing and retaining the waste liquid from the liquid ejection head, the cartridge becomes long and narrow. In this embodiment, however, the connective portion of the cartridge, through which the waste liquid resulting from the preparatory ejection from the liquid ejection head is discharged and absorbed into the liquid retaining members is not located at one of the lengthwise ends of the cartridge. Therefore, the problem that the waste liquid fails to be efficiently absorbed into the liquid retaining members, and evenly dispersed therein, does not occur. More specifically, the connective portion through which the waste ink which results as liquid is suctioned through the nozzles of the liquid ejection head in order to maintain the liquid ejection head in terms of liquid ejection reliability is positioned rearward of the front end of the liquid container in terms of the liquid cartridge insertion direction. With the provision of this arrangement, the waste liquid is absorbed into the liquid retaining members, from the roughly mid points of the liquid retaining members in terms of the lengthwise direction thereof. Therefore, as the waste liquid is absorbed into the liquid retaining members, it is evenly distributed in the liquid retaining members. In other words, it is assured that the waste liquid is absorbed into the waste liquid retaining members, and is evenly dispersed throughout the entirely of the waste liquid retaining members in the waste liquid catching portions. Even dispersion of the waste liquid throughout the waste liquid retaining members minimizes the possibility of the local concentration of the waste liquid, minimizing thereby the possibility that the liquid leaks within, or out of, the liquid-jet printer, due to the vibrations, impacts resulting from falls, changes in ambience, for example, temperature, when the printer is transported by a user, with the liquid cartridge (ink cartridge) left in the printer. This embodiment is particularly effective when applied to the ink cartridge to be mounted in the small ink jet printer, in particular, an ink cartridge to be mounted in a portable ink jet printer, that is, an ink jet printer likely to be frequent carried by a user. Further, in this embodiment, the total of the capacities of the second and first waste liquid retaining members is made roughly the same as the total of the capacities of the plurality of liquid pouches different in the color of the ink therein. To elaborate, the number of prints printable by a printer is determined by the amount of the liquid stored in the ink cartridge(s) in the printer. Thus, in this embodiment, a combination of liquid retaining members capable of absorbing and retaining the waste liquid by the amount equal to the total amount of liquid necessary to yield a predetermined number of prints is placed in the ink cartridge. Therefore, the waste liquid retaining members in this embodiment are smaller in volume than the counterparts in a liquid cartridge in accordance with the prior art, making it thereby possible to reduce the main assembly of a recording apparatus in size. Further, the waste liquid resulting from the out-of-boundary ejection, and the liquid ejected discharged during the maintenance of the ink jet head, are retained in the waste liquid retaining members in the ink cartridge, and are removed from the recording apparatus as the ink cartridge is replaced. Therefore, the waste ink does not remain permanently accumulated in the recording apparatus main assembly. Therefore, not only it is possible to prevent a recording apparatus from being increased in weight by the waste liquid, but also, to reduce the possibility of the liquid leakage in the recording apparatus.

Next, referring to FIGS. 9-11, modifications of this embodiment will be described. These modifications may be optionally applied in combination as necessary.

(Modification A)

Figure 9:
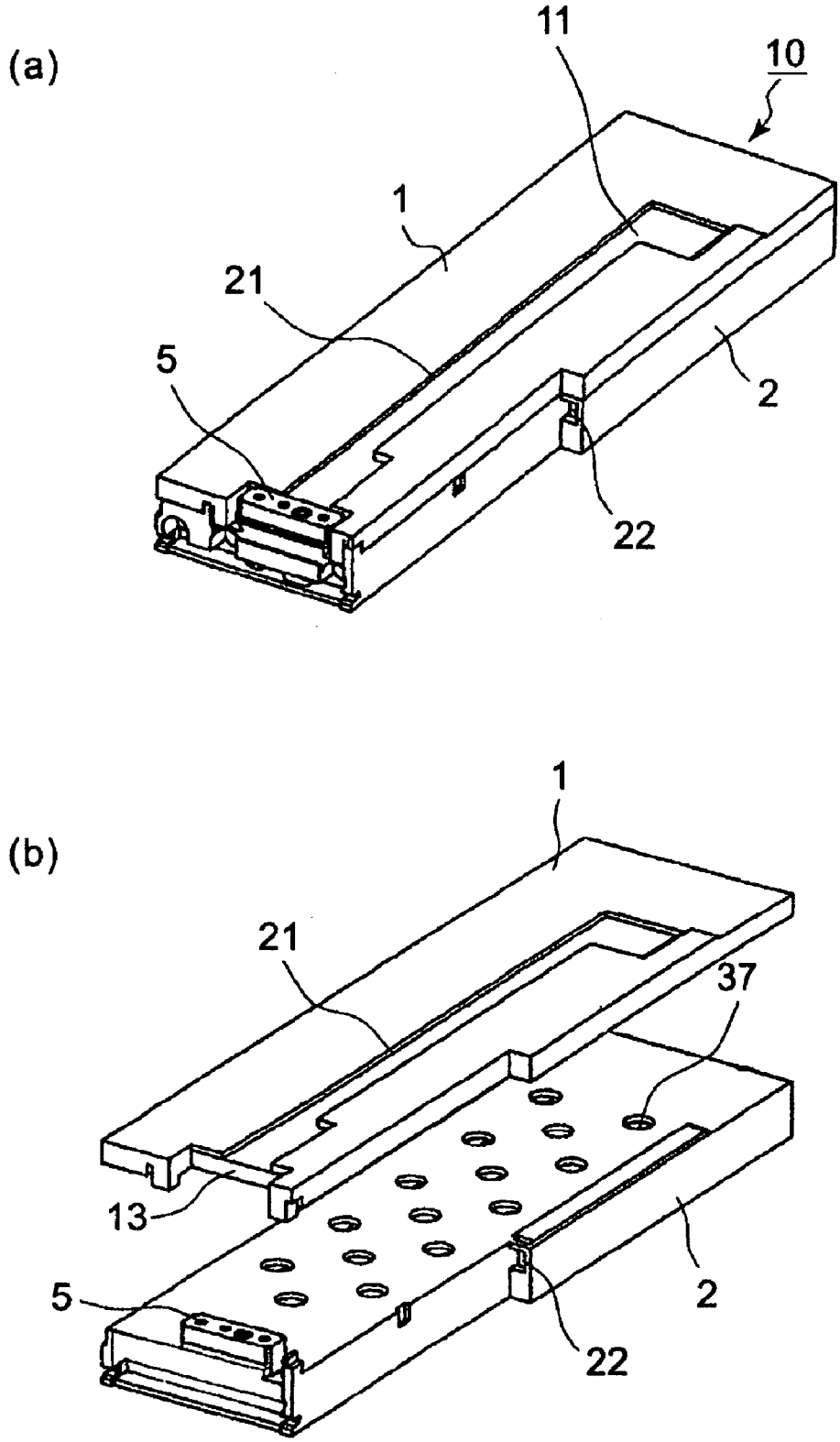
FIG. 9(*a*) is an external perspective view of a modified version of the ink cartridge in the second embodiment of the present invention, and FIG. 9(*b*) is an exploded perspective view of the same.

FIG. 9 includes external and exploded perspective views of the ink cartridge in the modification of the second embodiment of the present invention. In this modification, the boxy ink container shell 2, to the top wall of which the first waste ink retaining member is fixed, is provided with a one millimeter thick partitioning wall, which is between the second waste ink retaining member 13 and ink pouch holding portion 3. This partitioning wall is provided with 15 holes 37 with a diameter of 5 mm. The total amount of the ink absorbable by the second waste ink retaining member 13 and first waste ink retaining member 14 is roughly equal to the total of the ink capacity of the plurality of ink pouches held in the ink cartridge. Should an ink pouch in the ink pouch holding portion 3 break, the leaked ink is absorbed into the second waste ink retaining member 12 through the holes 37. The capillary force in the second waste ink retaining member 13 is greater than that of each of the holes 37. Therefore, the leaked ink is swiftly absorbed into the second waste ink retaining member 13, without remaining in the holes 37, being thereby prevented from soiling the hands of a user by leaking out of the ink cartridge.

(Modification B)

Figure 10:
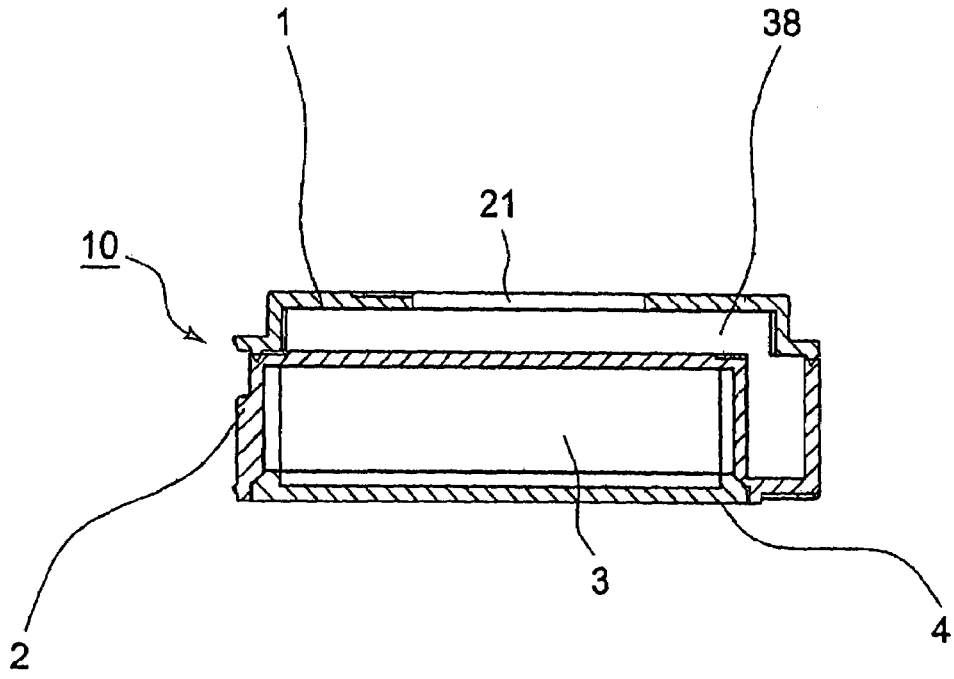
FIG. 10 is an external perspective view of another modified version of the ink cartridge in the second embodiment of the present invention.

FIG. 10 is an external perspective view of the ink cartridge in another modification of the second embodiment of the present invention. This modification is different from the second embodiment in that the second waste ink retaining member 13 and first waste ink retaining member 14 in the second embodiment are replaced with a single piece of waste ink retaining member, that is, a waste ink retaining member 38. Structurally, it is possible to use the second waste ink retaining member 13 in place of the ink retaining member 38; it is possible to make the second waste ink retaining member 13 larger, and bend the excess portion of the larger second waste ink retaining member 13 into the first waste ink retaining member chamber. However, in order to realize the effect similar to that of the second embodiment, the ink retaining member 38 must be structured so that the capillary force in the ink retaining member 38 gradually reduces from the surface facing the first ink catching hole 21 toward the connective portion 22 in FIG. 10.

(Modification C)

Figure 11:
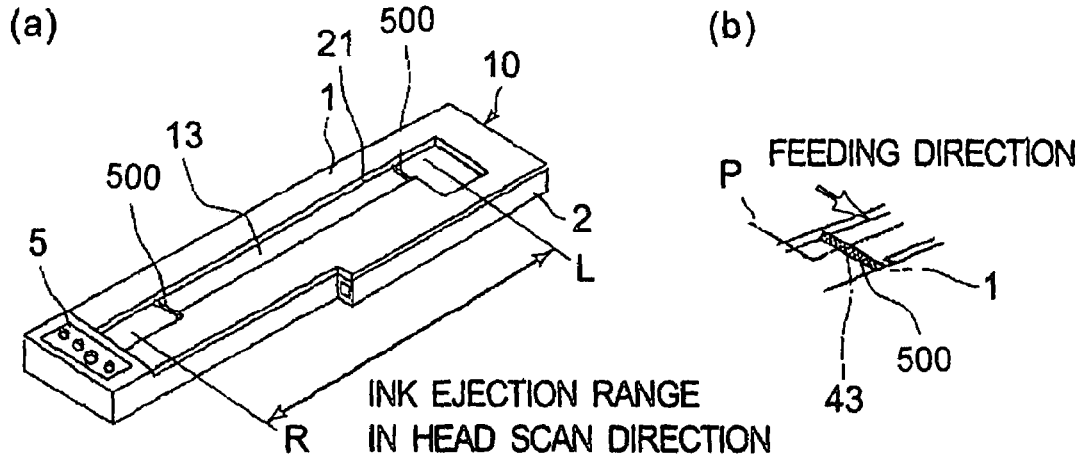
FIG. 11, comprising FIGS. 11(*a*) and 11(*b*), is an external perspective view of yet another modified version of the ink cartridge in the second embodiment of the present invention.

FIG. 11 is an external perspective view of the ink cartridge in another modification of the second embodiment of the present invention. The structure of the ink cartridge in this modification is similar to that in the second embodiment, except that the waste ink catching and retaining portion of the ink cartridge is provided with three waste ink retaining member chambers created by the addition of a pair of partitioning walls 500 to the ink catching and retaining portion, so that the waste ink retaining members for catching and retaining the above described waste ink, inclusive of mist, resulting from the preparatory ejection, become independent from the waste ink retaining member for catching and retaining is the waste ink, inclusive of mist, resulting from the out-of-boundary ejection during borderless printing. Each of the pair of partitioning walls 500 is structured so that the top edge of the partitioning wall 500 will be below the top surface of the lid 1 of the ink container, and also, so that it is tilted toward the center of the second waste ink retaining member 13 to increase its surface area. Further, the partitioning wall 500 is provided with a plurality of fine holes 43. The partitioning wall 500 has only to be configured so that the ink is guided to the center portion of the second waste ink retaining member 13. In other words, the attitude of the partitioning wall 500 does not need to be limited to the slanted one, as long as the ink is guided toward the center of the second waste ink retaining member. With the employment of this attitude for the partitioning walls 500, the waste ink resulting from the out-of-boundary ejection is swiftly guided to the center portion of the second waste ink retaining member 13, and absorbed thereby. Moreover, the provision of the partitioning walls 500 is effective to compensate for the amount of the rigidity reduced by the provision of the first ink catching hole 21.

Embodiment 3

Figure 12:
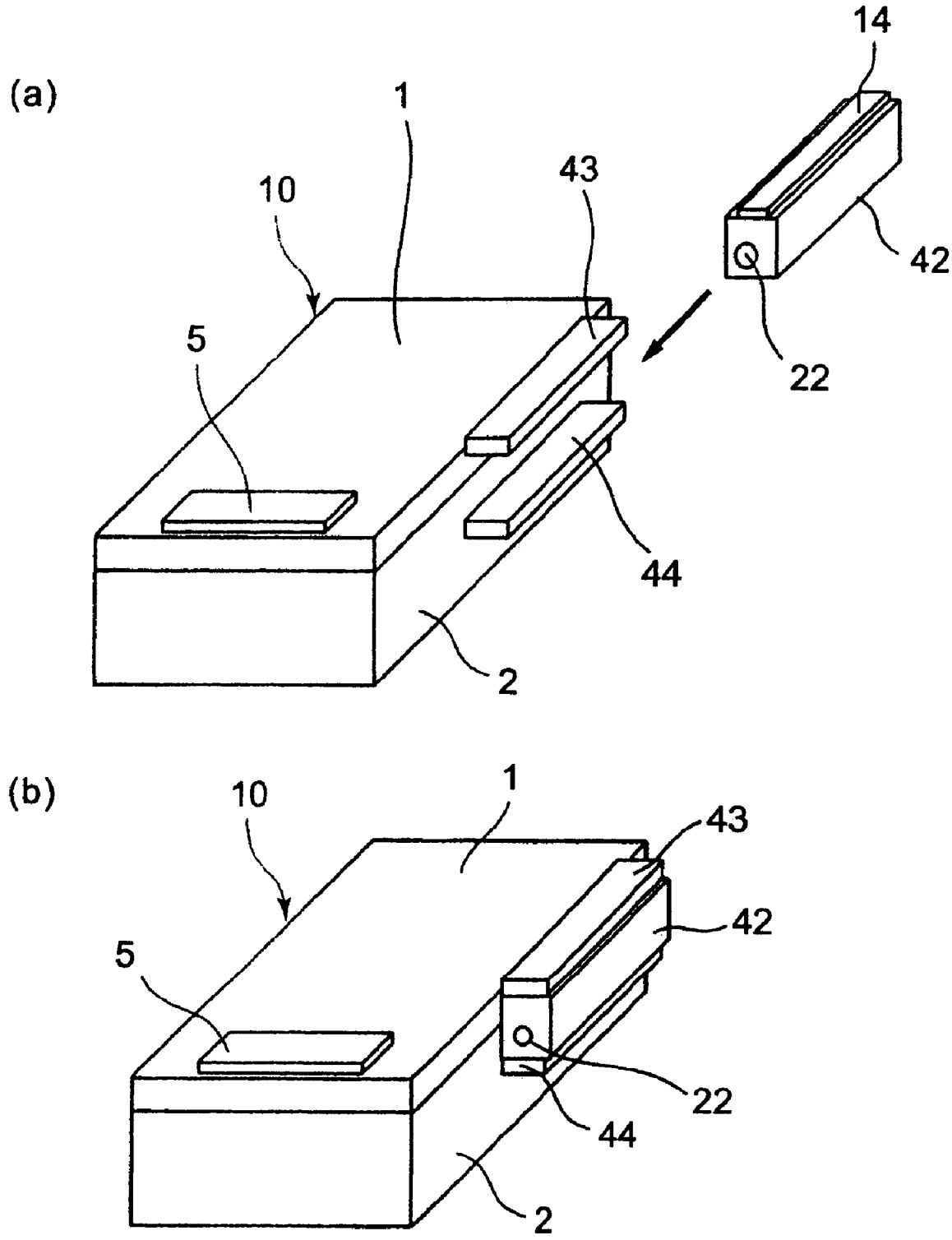
FIG. 12, comprising FIGS. 12(*a*) and 12(*b*), is an external perspective view of the ink cartridge in the third embodiment of the present invention.

Next, referring to FIG. 12, the third embodiment of the present invention will be described. FIG. 12 is an external perspective view of the ink cartridge in the third embodiment of the present invention. Externally, the ink cartridge 10 in this embodiment essentially comprises: a boxy frame 2 having the ink pouch chamber for holding a single or plurality of ink pouches; and a waste ink unit (container) 42 which contains the first waste ink retaining member for absorbing the waste ink which results as ink is suctioned through the ejection orifices of the ink jet head of the printer main assembly to restore ink jet performance. The boxy frame 2 is provided with a pair of supporting members 43 and 44, which are attached to one of the side walls thereof to hold the waste ink unit 42. The supporting member 43 is provided a hole, which open where the supporting member 43 makes contact with the waste ink unit 42, and through which the second waste ink retaining member 13 is exposed. Thus, as the waste ink unit 42 is inserted between the pair of supporting members 43 and 44, the second waste ink retaining member is mechanically connected to the first waste ink retaining member. The front wall of the waste ink unit 42, in terms of the direction in which the waste ink unit 42 is inserted between the pair of supporting members 43 and 44, is provided with a connective portion 22 through which the drain tube is inserted into the first waste ink retaining portion 14. The boxy frame 2, pair of supporting members 43 and 44, and waste ink unit 42 are structured so that as the waste ink unit 42 is inserted between the pair of supporting members 43 and 44 (FIG. 12(*b*), the first waste ink retaining member 14 in the waste ink unit 42 comes into contact with the second waste ink retaining member 13 exposed through the hole of the supporting member 43. After the fitting of the ink cartridge main assembly with the waste ink unit 42, the ink cartridge 10 in this embodiment is virtually the same in structure and function as the above described ink container in the second embodiment. In other words, this embodiment is characterized in that the waste ink holding portion of the ink cartridge, which is for holding the waste ink resulting when ink is suctioned through the nozzles of the ink jet head in order to keep the ink jet head reliable in ejection performance, is made independent from the cartridge main assembly, so that it can be removably attached to the cartridge main assembly. With the provision of this structural arrangement, the first waste ink retaining member in this embodiment may be substantially smaller than that in the preceding embodiments, because the waste ink unit 42 can be replaced without replacing the entirety of the ink cartridge, if the ink container in this embodiment happens to be used in such a manner that the cumulative amount of the waste ink resulting when ink is suctioned through the nozzles of the ink jet head to keep the ink jet reliable in terms of ejection performance is greater than the capacity of the waste ink unit 42. Therefore, it is possible to reduce the running cost of an ink jet recording apparatus.

As described above, compared to the second embodiment, this embodiment can further reduce the size of an ink cartridge. Obviously, this embodiment can offer the same benefits as those offered by the second embodiment. That is, in order to use an ink cartridge to provide an ink jet recording apparatus capable of printing across the entirety of the surface of printing medium by shuttling its ink jet head in the direction intersectional to the printing medium conveyance direction, with a portion for catching the ink ejected from the ink jet head toward slightly outside the edges of the recording medium, and a portion for retaining the ink caught by the ink catching portion, without requiring increase in the ink cartridge size as well as printer main assembly size, the ink cartridge must be shaped long and narrow, because the waste ink catching portion of the ink cartridge must extend from one edge of the printing medium to the other. With the provision of this structural arrangement, the waste ink is reliably caught by the waste ink catching portion, and is evenly dispersed in the waste ink retaining portion. Therefore, it is possible to provide an ink cartridge, which is superior in ink absorption efficiency, lighter, and smaller, compared to an ink cartridge in accordance with the prior art. Obviously, this embodiment does not add to the cost of the absorption of the excess ink, that is, the waste ink, by the ink cartridge. Further, it does not require the ink jet printer main assembly to be increased in size according to the increase in the volume of the waste ink absorbing portion, which must be set according to the length of time the ink jet printer is operated.

Embodiment 4

Next, the fourth embodiment of the present invention, which is related to the desirable distance between the second waste ink retaining member 13 of the ink cartridge, and the surface of the ink jet head having the ejection orifices, in the ink jet printer in each of the above described embodiments of the present invention, will be described in detail. Referring to FIGS. 1 and 3, in the ink jet printer, the ink jet head 33 is moved in a manner of scanning the printing paper (recording medium) P; it is shuttled primarily in the direction perpendicular to the direction in which the printing paper P is conveyed. The printer main assembly is structured so that while the printing paper P is conveyed through the printer main assembly, the printing paper P is always between the ink cartridge 10 and ink jet head 33, and also, so that the first waste ink catching hole 21 extends from one end of the primary scanning range, inclusive of the above described out-of-boundary portions, of the ink jet head 33, to the other. In other words, the ink ejected toward slightly outside of the edges of the printing paper P (in terms of both the printing paper conveyance direction and the direction perpendicular thereto) is absorbed by the second waste ink retaining member 13 exposed through the first ink catching hole 21.

At this time, the flight of a liquid droplet in the air will be described based on theoretical computations. It is assumed that a liquid droplet is a in radius, and is v0 in initial velocity. When the ambience is 25° C. in temperature and 1 in atmospheric pressure, the air density $\rho_{air}=1.29\times10^{-3}$ g/cm$^3$, and the kinetic viscosity of air $\nu_{air}=1.50\times10^{-1}$ cm$^2$/s. Further, Reynolds number R is:

$$R=L\cdot v/\nu_{air}$$

L: characteristic length $\nu_{air}$: kinetic viscosity v: velocity.

When v=14 M/s, Reynolds number R=1-20, being sufficiently small. When Reynolds number is sufficiently small, the inertia term in Navier-stokes equation may be ignored to obtain the approximate value (stokes approximation) thereof. In other words, the following linear equation regarding the air flow around a liquid droplet is solved:

$$\text{div } v=0$$

$$\partial v/\partial t=1/\rho_{air}\,\text{grad}\,p+\nu_{air}\,\Delta v.$$

As for the liquid droplet movement, the resistance of the air flow against a liquid droplet is calculated from the above equation. When a liquid droplet is a in radius, and v in velocity, the resistance F is:

$$F=6\pi\rho_{air}\,\nu_{air}av.$$

Thus, the equation for the liquid movement is:

$$md/dt\,(dx/dt)=-6\pi\rho_{air}\,\nu_{air}a\,dx/dt$$

(assuming that liquid mass is m, and liquid is flying in parallel to x axis).

Prior to flight, that is, when t=0, dx/dt=v0, and x=0

$$x=mv0/(6\pi\rho_{air}\nu_{air}a)\,(1-\exp(-6\pi\rho_{air}\nu_{air}a/m\,t))$$

$$dx/dt=v0\,\exp(-6\pi\rho_{air}\nu_{air}a/m\,t)$$

substituting the liquid droplet radius a and ink density $\rho_{ink}$ for the liquid droplet mass, m=4/3 πa3ú $\rho_{ink}$. Therefore, $$x=2\,\rho_{ink}v0\,a3/(9\,\rho_{air}\nu_{air})(1-\exp(-9\,\rho_{air}\nu_{air}/(2\rho_{ink}a2)\,t))$$

$$dx/dt=v0\,\exp\,(-9\rho_{air}\,\nu_{air}/(2\,\rho_{ink}a2)\,t).$$

The initial velocity is assumed to be 14 m/s.

Figure 13:
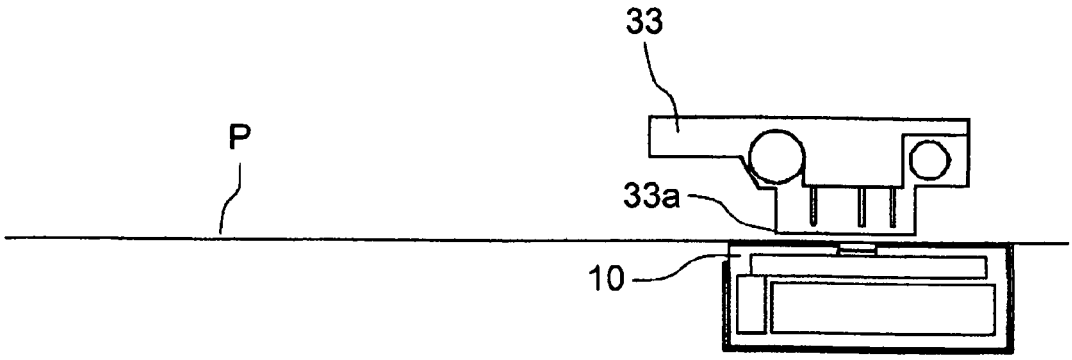
FIG. 13 is a schematic drawing for depicting the distance between the second waste ink retaining member in the ink cartridge and the surface of the ink jet head having the ejection orifices, in each embodiment of the present invention.
Figure 14:
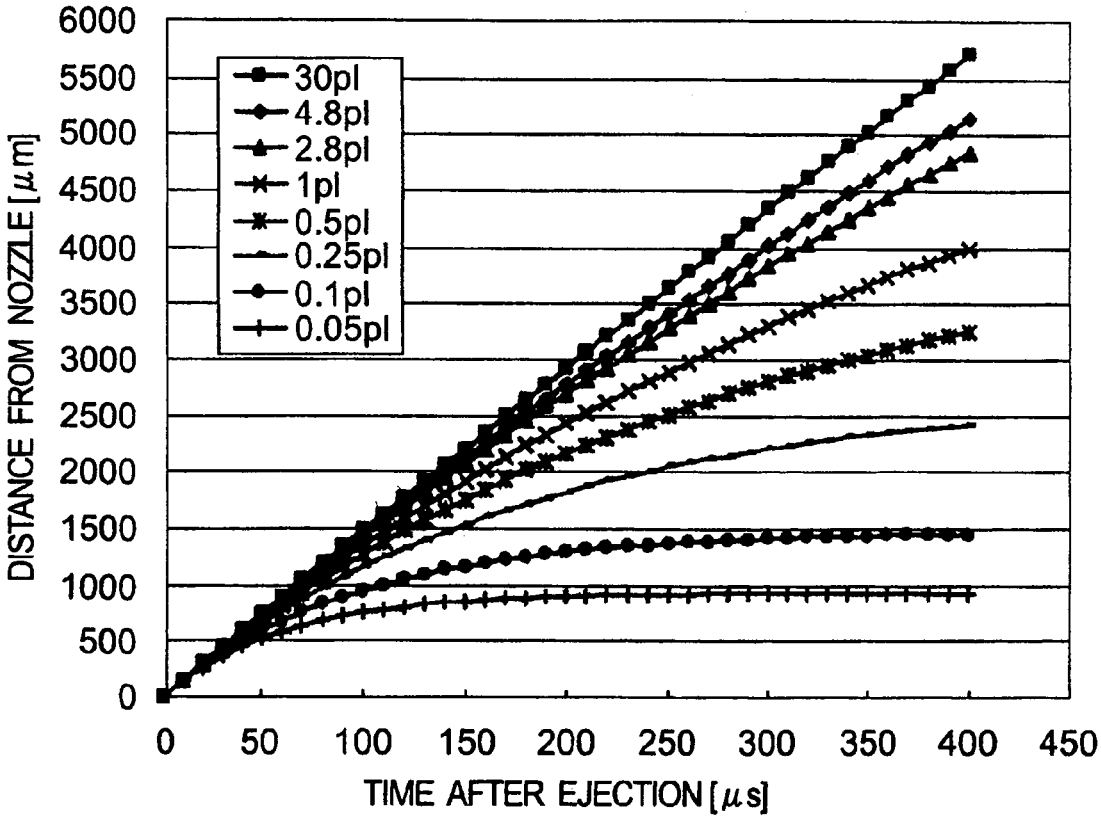
FIG. 14 is a graph showing the relationships among ink droplet volume, elapsed time after ejection, and the distance an ink droplet has traveled.

Assuming that a liquid droplet is spherical, changes in the position (distance from orifice) of each of liquid droplets different in volume (radius) were obtained. The relationship between the elapsed time t[s] from the moment of ejection (t0=0 [s]) and the velocity v[m/s] of a liquid droplet at the point in time of t[s] from the moment of ejection can be obtained from the Stokes approximation. From this relationship, the relationship between the elapsed time t[s] and the distance x[mm] (at orifice, x=0) each of the ink droplets different in volume was obtained, and is shown in FIG. 14. As the elapsed time increases, an ink droplet reduces in velocity. when the velocity of an ink droplet is no more than 1 m/s, it simply floats in the printer main assembly. If the floating ink droplet adheres to the printing paper, it may degrade print quality. For example, if an ink droplet with a volume of no less than 0.5 pl (pico-liter) adheres to the printing paper, the image quality degradation caused by the adhesion of the ink droplet is detectable by the naked eye. Thus, in order to prevent an ink droplet with a volume of no less than 0.5 pl from floating in the printer main assembly, the ink cartridge is positioned in the ink jet printer main assembly, as shown in FIG. 13, so that the distance between the ink jet head surface 33*a* having the ejection orifices and the second waste ink retaining member 13 becomes no more than 3.3 mm.

Embodiment 5

Figure 15:
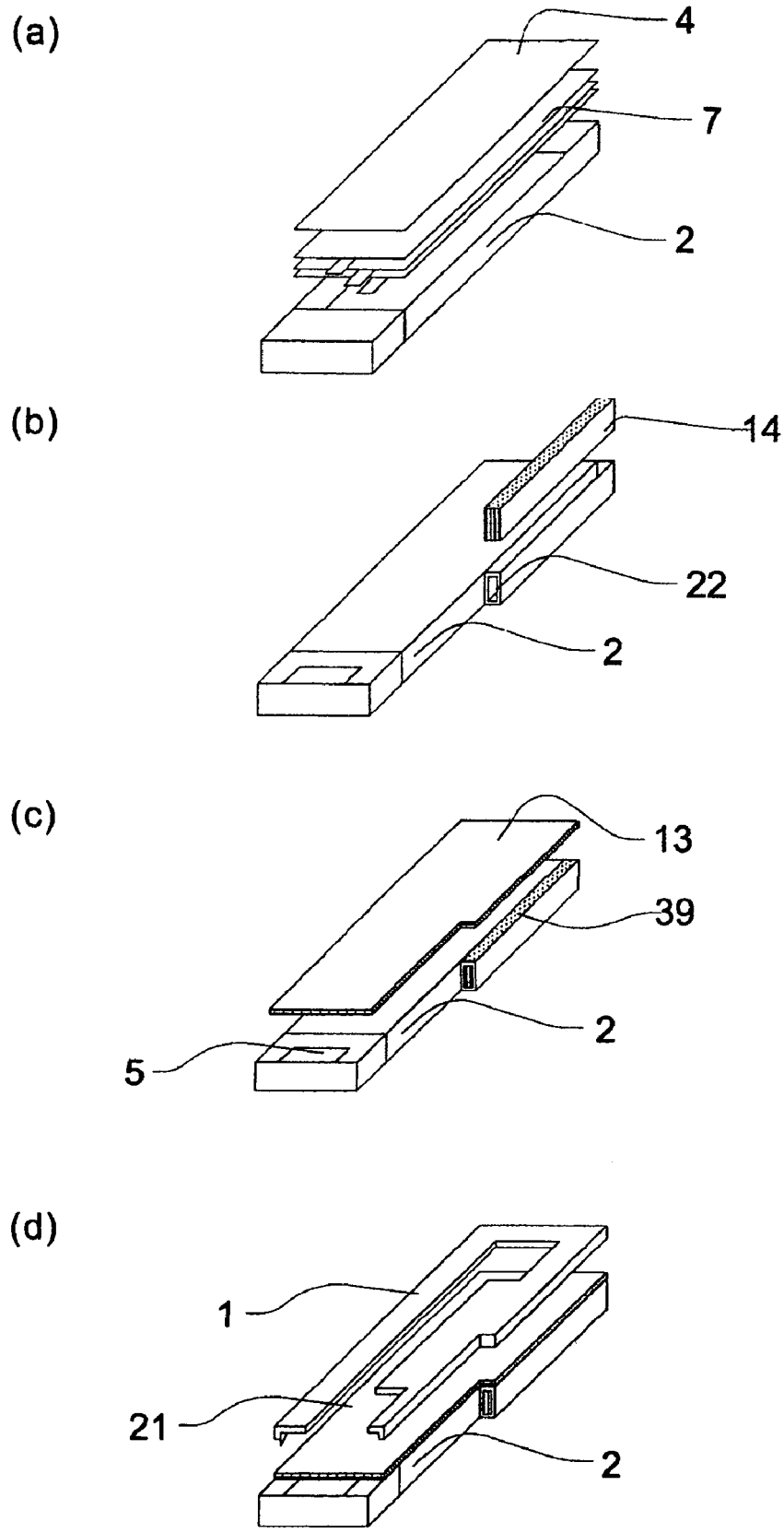
FIGS. 15(*a*)-15(*d*) are exploded perspective views of an ink cartridge in accordance with the present invention, sequentially showing the method for manufacturing the ink cartridge.

Next, referring to FIG. 15, the fifth embodiment of the present invention, which is related to the method for manufacturing the ink cartridges in the preceding embodiments, will be described in detail. FIGS. 15(*a*)-15(*d*) are partially exploded perspective views of the ink cartridge in accordance with the present invention, showing the manufacturing sequence therefor.

Figure 16:
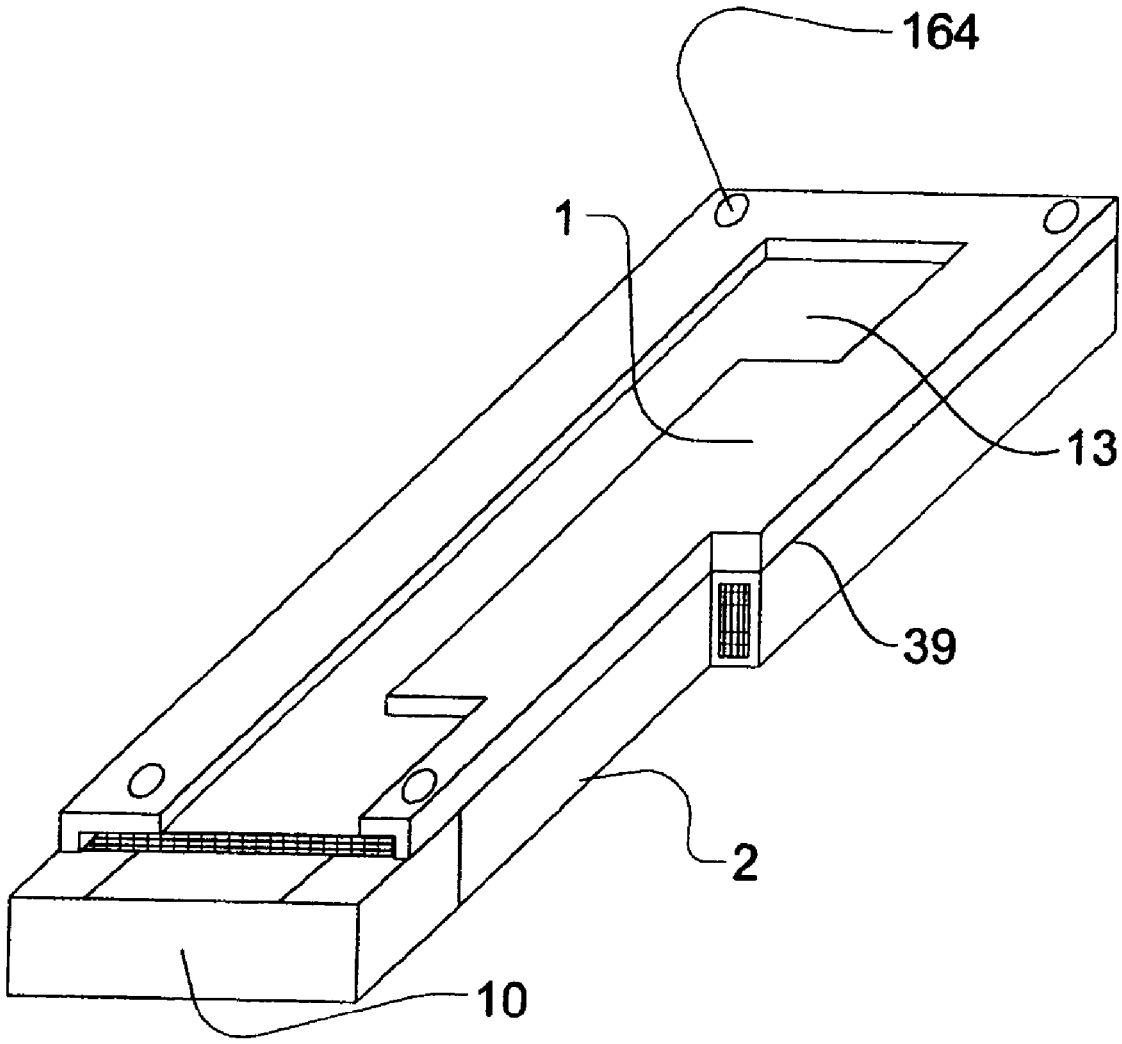
FIG. 16 is an external perspective view of the ink cartridge in the modification of the fifth embodiment of the present invention.

First, the boxy frame the ink container, having an ink pouch chamber in which the three ink pouches containing yellow, magenta, and cyan inks, one for one, are disposed, is prepared. More specifically, referring to FIG. 15(*a*), in order to prepare the above described boxy frame, first, the plurality of ink pouches 7 for storing the plurality of inks, one s for one, are prepared, and are placed in the boxy ink container frame. Then, the bottom lid 4 of the ink container is attached to the boxy ink container frame to complete the ink container. When placing the ink pouches in the boxy ink container frame, the ink outlet of each ink pouch is connected to the corresponding hole (FIGS. 3 and 7) of the joint portion 5 of the boxy ink container frame 2 (joint between ink outlet of ink pouch and corresponding hole is not shown). Next, referring to FIG. 15(*b*), the first waste ink retaining member 14 is inserted into the recess in the side portion of the boxy frame 2 completed by the attachment of the bottom lid 4 to the boxy ink container frame. Then, the lid 1 of the ink container is placed on the boxy frame 2, and welded thereto, as shown in FIG. 15(*d*). As the method for fixing the lid 1 to the boxy frame 2, ultrasonic welding is most desirable. However, the lid 1 may be fixed by an ordinary thermal welding method, or may be glued. In the case that an ink container comprises the second waste ink retaining member 13, the second waste ink retaining member 13 is placed on the top surface of the boxy frame 2, next to the first waste ink retaining member 14, preferably, in contact with the first waste ink retaining member 14, as shown in FIG. 15(*c*). As for the filling of the ink pouches with ink, ink has only to be injected into each ink pouch after the plurality of ink pouches are connected to the corresponding holes of the joint portion 5. Although in the preceding embodiments, the ink pouches are placed in the ink pouch chamber 3 of the ink container, and thereafter, inks are stored in the ink pouches, this manufacturing arrangement is not intended to limit the scope of the present invention. Incidentally, the manufacturing sequence shown in FIG. 15 may be altered; it may be as follows. That is, first, the boxy frame 2 is fitted with the second waste ink retaining member 13 and first waste ink retaining member 14. Then, the combination of the plurality of ink pouches and the joint portion 5, to the holes of which the outlets of the ink pouches have been connected, is placed in the boxy frame 2. Lastly, the bottom lid 4 is welded to the boxy frame 2. In the case of this manufacturing method, inks may be injected into the ink pouches immediately after the outlets of the ink pouches are connected to the holes of the joint portion 5. It does not matter which of the two manufacturing sequences is employed. However, the sequence shown in FIG. 15 is preferable, because the first and second waste ink retaining members are placed in the boxy frame 2 at the last, and therefore, should ink leak from any of the ink pouches and soil the waste ink retaining members during the manufacturing of an ink container, the waste ink retaining members can be easily replaced, as long as the leakage occurs before the manufacturing step shown in FIG. 15(*d*). Although in the case of the sequence, shown in FIG. 15, for manufacturing the ink cartridge in accordance with the present invention, the top and bottom lids of the container are ultrasonically welded to the boxy frame portion of the ink cartridge, they may be attached with the use of easily reversible means such as screws or the like, as shown in FIG. 16.

Incidentally, the preceding embodiments of the present invention have been described with reference to the waste ink retaining members (ink absorbent member) as waste ink catching and absorbing members. As for the material for the ink absorbing members, any substance may be employed as long as it can absorb and retain ink. For example, foamed urethane, a dense tangle of fibers, etc., are preferable substances. Further, the waste ink catching and retaining portion does not need to contain the ink absorbing member(s); in other words, it may be empty, as long as it is capable of catching and retaining waste ink. However, in consideration of the fact that an ink container is periodically replaced, not only is the waste ink catching portion desired to be capable of catching ink, but also retaining it. Thus, instead of filling the waste ink catching portion with an ink absorbing member, the internal surfaces of the ink catching portion may be provided with a plurality of fine grooves so that the waste ink caught by the ink catching portion will be etained in the grooves by the capillary force of the grooves.

While the invention has been described with reference to the structures disclosed herein, it is not confined to the details set forth, and this application is intended to cover such modifications or changes as may come within the purposes of the improvements or the scope of the following claims.

INDUSTRIAL APPLICABILITY

As described above, according to the present invention, there is provided an ink cartridge capable of contributing to the size reduction of an ink jet recording apparatus capable of borderless printing.

The invention claimed is:

1. An ink cartridge for an ink jet recording apparatus, wherein said ink jet recording apparatus includes an ink jet head carried on a carriage for ejecting ink onto a recording material while scanning the recording material in a direction crossing with a feeding direction of the recording material, recovery means for discharging ink from said ink jet head for not effecting recording, and a mounting portion for detachably mounting said ink cartridge, wherein said mounting portion is provided in a region interposing a feeding path for the recording material with a carriage scanning region in which said carriage is scanningly movable, wherein said ink cartridge comprises:

an ink accommodating container for accommodating ink to be supplied to said ink jet head, wherein said ink cartridge has a length covering a full width of a scanning range of said carriage;

an absorbing material for absorbing and retaining the ink not used for recording;

a casing for accommodating said ink accommodating container and said absorbing material;

a joint portion for discharging the ink from said ink accommodating container to an outside thereof, said joint portion being disposed on a longitudinal side of said ink cartridge, wherein said longitudinal side is a side which opposes said ink jet head when said ink cartridge is mounted to said mounting portion, and wherein said joint portion is disposed at a position on said longitudinal side which opposes a home position of said carriage when said ink cartridge is mounted to said mounting portion;

a first opening which is provided in said longitudinal side and which has a dimension larger than a width of the recording material; and a second opening provided in a portion intermediate longitudinal ends of another side continuing with said longitudinal side, wherein a first absorbing material for collecting the ink which has been ejected, for effecting recording, from said ink jet head and which has been ejected to an outside of the recording material is disposed in said first opening, and wherein a second absorbing material for collecting the ink which has been discharged from said recovery means is disposed in said second opening.

2. An ink cartridge according to claim 1, wherein said first absorbing material and said second absorbing material are accommodated in said casing partly contacted to each other.

3. An ink cartridge according to claim 2, wherein said first absorbing material and said second absorbing material comprise fibers, and said first absorbing material has a density which is higher from that of said second absorbing material.

4. An ink cartridge according to claim 1, wherein said first absorbing material and said second absorbing material are accommodated in said casing as an integral member.

5. An ink cartridge according to claim 1, wherein said ink cartridge is mounted to said mounting portion by sliding along the length of said ink cartridge, and said longitudinal side is different from a leading side when said ink cartridge is mounted to the mounting portion, wherein said intermediate portion of said another side has a face oriented in a mounting direction in which said ink cartridge is mounted, and wherein said second opening is provided in said face.

6. An ink cartridge according to claim 5, further comprising an engaging portion for positioning said ink cartridge relative to said ink jet recording apparatus, in a region of said another side intermediate said leading side and said face.

7. An ink cartridge according to claim 1, wherein said first absorbing material is exchangeable, and said second absorbing material is exchangeable.

8. An ink cartridge according to claim 1, wherein said first opening includes a first opening region for collecting the ink ejected to outsides of a leading edge and a trailing edge of the recording material with respect to the feeding direction, and second and third opening regions for collecting the ink ejected widthwise outsides of widths of the recording material.

* * * * *